US010305224B2

(12) United States Patent
Girard, Jr.

(10) Patent No.: US 10,305,224 B2
(45) Date of Patent: May 28, 2019

(54) CONTROLLED IMPEDANCE EDGED COUPLED CONNECTORS

(71) Applicant: Amphenol Corporation, Wallingford Center, CT (US)

(72) Inventor: Donald A. Girard, Jr., Bedford, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/598,173

(22) Filed: May 17, 2017

(65) Prior Publication Data

US 2017/0338595 A1 Nov. 23, 2017

Related U.S. Application Data

(60) Provisional application No. 62/338,292, filed on May 18, 2016.

(51) Int. Cl.
*H01R 43/26* (2006.01)
*H01R 13/629* (2006.01)
(Continued)

(52) U.S. Cl.
CPC ..... *H01R 13/642* (2013.01); *H01R 13/629* (2013.01); *H01R 13/6474* (2013.01);
(Continued)

(58) Field of Classification Search
CPC .. H01R 23/7005; H01R 23/27; H01R 13/629; H01R 13/631; H01R 13/28; H01R 13/64;
(Continued)

(56) References Cited

U.S. PATENT DOCUMENTS 2,124,207 A * 7/1938 Neesen ..... H01R 23/27 439/284
3,229,240 A * 1/1966 Harrison, Sr. ..... H01R 31/00 439/651
(Continued)

FOREIGN PATENT DOCUMENTS

CN 2519434 Y 10/2002
JP 2006-108115 A 4/2006

OTHER PUBLICATIONS

International Search Report and Written Opinion for International Application No. PCT/US2017/033122 dated Aug. 8, 2017.
(Continued)

*Primary Examiner* — Gary F Paumen
(74) *Attorney, Agent, or Firm* — Wolf, Greenfield & Sacks, P.C.

(57) ABSTRACT

An electrical interconnection system comprising one or more insulative projecting members. The electrical interconnection system may comprise a first connector and a second connector. Each connector may comprise one or more projecting members extending along the mating direction. When the connectors are mated, the projecting member(s) may be configured to affect the impedance of the signal conductors of the connectors. In a partially mated position, the projecting member(s) may be configured to fill at least a portion of the region separating the connectors, thereby replacing air that might otherwise exist in that separation with a dielectric member. Because this dielectric constant is closer to what would be experienced in the fully mated position, the magnitude of the change in impedance as a result of separation may be less than had the entire space been filled with air.

21 Claims, 24 Drawing Sheets

(51) Int. Cl.

| | |
|---|---|
| ***H01R 13/642*** | (2006.01) |
| ***H01R 13/6474*** | (2011.01) |
| ***H01R 13/6477*** | (2011.01) |
| ***H01R 13/6581*** | (2011.01) |
| ***H01R 13/6586*** | (2011.01) |
| ***H01R 13/6587*** | (2011.01) |

(52) U.S. Cl.
CPC ..... *H01R 13/6477* (2013.01); *H01R 13/6581* (2013.01); *H01R 13/6586* (2013.01); *H01R 43/26* (2013.01); *H01R 13/6587* (2013.01)

(58) Field of Classification Search
CPC ..... H01R 13/6456; H01R 13/642; H01R 13/6474; H01R 13/6477; H01R 13/6581; H01R 13/6586; H01R 13/6587; H01R 43/26
USPC ..... 439/378, 374, 680, 284, 924.1
See application file for complete search history.

(56) References Cited

U.S. PATENT DOCUMENTS 3,715,706 A 2/1973 Cook et al.
4,632,476 A 12/1986 Schell
4,708,660 A * 11/1987 Claeys ..... H01R 13/28 439/248
4,795,375 A * 1/1989 Williams ..... H01R 13/53 439/680
4,806,107 A 2/1989 Arnold et al.
4,826,443 A 5/1989 Lockard
4,846,727 A 7/1989 Glover et al.
4,871,316 A 10/1989 Herrell et al.
4,913,667 A * 4/1990 Muz ..... H01R 13/514 439/680
4,975,084 A 12/1990 Fedder et al.
4,990,099 A * 2/1991 Marin ..... H01R 13/642 439/171
5,066,236 A 11/1991 Broeksteeg
5,176,538 A 1/1993 Hansell, III et al.
5,306,171 A * 4/1994 Marshall ..... H01R 12/716 439/284
5,334,050 A 8/1994 Andrews
5,429,520 A 7/1995 Morlion et al.
5,429,521 A 7/1995 Morlion et al.
5,433,617 A 7/1995 Morlion et al.
5,433,618 A 7/1995 Morlion et al.
5,484,310 A 1/1996 McNamara et al.
5,496,183 A 3/1996 Soes et al.
5,702,258 A 12/1997 Provencher et al.
5,733,148 A * 3/1998 Kaplan ..... H01R 13/6456 439/680
5,743,765 A 4/1998 Andrews et al.
6,116,926 A 9/2000 Ortega et al.
6,146,202 A 11/2000 Ramey et al.
6,168,466 B1 * 1/2001 Chiou ..... H01R 24/64 439/607.02
6,293,827 B1 9/2001 Stokoe
6,299,438 B1 10/2001 Sahgian et al.
6,322,379 B1 11/2001 Ortega et al.
6,364,718 B1 * 4/2002 Polgar ..... H01R 13/64 439/488
6,503,103 B1 1/2003 Cohen et al.
6,551,140 B2 4/2003 Billman et al.
6,776,659 B1 8/2004 Stokoe et al.
6,843,657 B2 1/2005 Driscoll et al.
7,077,658 B1 7/2006 Ashman et al.
7,163,421 B1 1/2007 Cohen et al.
7,267,515 B2 9/2007 Lappöhn
7,331,830 B2 2/2008 Minich
7,354,274 B2 4/2008 Minich
7,371,117 B2 5/2008 Gailus
7,422,483 B2 9/2008 Avery et al.
7,485,012 B2 * 2/2009 Daugherty ..... H01R 13/514 439/540.1
7,686,659 B2 * 3/2010 Peng ..... H01R 12/725 439/660
7,722,401 B2 5/2010 Kirk et al.
7,775,802 B2 8/2010 Defibaugh et al.
7,789,676 B2 9/2010 Morgan et al.
7,794,278 B2 9/2010 Cohen et al.
7,811,129 B2 10/2010 Glover et al.
7,871,296 B2 1/2011 Fowler et al.
7,914,304 B2 3/2011 Cartier et al.
7,976,318 B2 7/2011 Fedder et al.
7,985,097 B2 7/2011 Gulla
8,016,616 B2 9/2011 Glover et al.
8,057,267 B2 11/2011 Johnescu
8,100,699 B1 1/2012 Costello
8,167,651 B2 5/2012 Glover et al.
8,210,877 B2 * 7/2012 Droesbeke ..... H01R 13/514 439/607.11
8,251,745 B2 8/2012 Johnescu et al.
8,371,876 B2 2/2013 Davis
8,469,745 B2 6/2013 Davis et al.
8,550,861 B2 10/2013 Cohen et al.
8,678,860 B2 3/2014 Minich et al.
8,814,595 B2 8/2014 Cohen et al.
9,509,101 B2 11/2016 Cartier et al.
9,564,696 B2 2/2017 Gulla
9,685,736 B2 6/2017 Gailus et al.
2003/0119362 A1 6/2003 Nelson et al.
2004/0005815 A1 1/2004 Mizumura et al.
2004/0224559 A1 11/2004 Nelson et al.
2005/0233610 A1 10/2005 Tutt et al.
2007/0021002 A1 1/2007 Laurx et al.
2007/0042639 A1 2/2007 Manter et al.
2007/0207641 A1 9/2007 Minich
2009/0011641 A1 1/2009 Cohen et al.
2009/0011664 A1 1/2009 Laurx et al.
2009/0017682 A1 1/2009 Amleshi et al.
2009/0305533 A1 12/2009 Feldman et al.
2009/0311908 A1 12/2009 Fogg et al.
2010/0144175 A1 6/2010 Helster et al.
2010/0291806 A1 11/2010 Minich et al.
2011/0130038 A1 6/2011 Cohen et al.
2011/0230096 A1 9/2011 Atkinson et al.
2012/0077369 A1 * 3/2012 Andersen ..... H01R 13/642 439/488
2012/0077380 A1 3/2012 Minich et al.
2012/0214344 A1 8/2012 Cohen et al.
2013/0109232 A1 5/2013 Paniaqua
2013/0143442 A1 6/2013 Cohen et al.
2013/0210246 A1 8/2013 Davis et al.
2013/0288521 A1 10/2013 McClellan et al.
2013/0288525 A1 10/2013 McClellan et al.
2013/0288539 A1 10/2013 McClellan et al.
2014/0057493 A1 2/2014 De Geest et al.
2014/0057494 A1 2/2014 Cohen
2014/0287627 A1 9/2014 Cohen
2014/0308852 A1 10/2014 Gulla
2014/0335707 A1 11/2014 Johnescu et al.
2015/0079829 A1 * 3/2015 Brodsgaard ..... H01R 24/84 439/284
2015/0236451 A1 8/2015 Cartier, Jr. et al.
2015/0236452 A1 8/2015 Cartier, Jr. et al.
2015/0280351 A1 10/2015 Bertsch
2016/0028189 A1 1/2016 Resendez et al.
2016/0141807 A1 5/2016 Gailus et al.
2016/0150633 A1 5/2016 Cartier, Jr.
2016/0150639 A1 5/2016 Gailus et al.
2016/0150645 A1 5/2016 Gailus et al.
2016/0181732 A1 6/2016 Laurx et al.
2016/0344141 A1 11/2016 Cartier et al.
2017/0025783 A1 1/2017 Astbury et al.
2017/0047692 A1 2/2017 Cartier et al.

OTHER PUBLICATIONS

International Search Report and Written Opinion dated May 13, 2015 for Application No. PCT/U52015/012463.
International Search Report and Written Opinion dated Mar. 11, 2016 for Application No. PCT/U52015/060472.

(56) References Cited

OTHER PUBLICATIONS

International Search Report and Written Opinion dated Apr. 30, 2015 for Application No. PCT/U52015/012542.
International Search Report and Written Opinion dated Nov. 3, 2016 for Application No. PCT/US2016/043358.

* cited by examiner

PRIOR ART

PRIOR ART

CONTROLLED IMPEDANCE EDGED COUPLED CONNECTORS

RELATED APPLICATIONS

This application claims priority to and the benefit of U.S. Provisional Patent Application No. 62/338,292, filed May 18, 2016, the entire contents of which are hereby incorporated herein by reference.

BACKGROUND

This patent application relates generally to interconnection systems, such as those including electrical connectors, used to interconnect electronic assemblies.

Electrical connectors are used in many electronic systems. It is generally easier and more cost effective to manufacture a system as separate electronic assemblies, such as printed circuit boards ("PCBs"), which may be joined together with electrical connectors. A known arrangement for joining several printed circuit boards is to have one printed circuit board serve as a backplane. Other printed circuit boards, called "daughterboards" or "daughtercards," may be connected through the backplane.

A known backplane is a printed circuit board onto which many connectors may be mounted. Conducting traces in the backplane may be electrically connected to signal conductors in the connectors so that signals may be routed between the connectors. Daughtercards may also have connectors mounted thereon. The connectors mounted on a daughtercard may be plugged into the connectors mounted on the backplane. In this way, signals may be routed among the daughtercards through the backplane.

Connectors may also be used in other configurations for interconnecting printed circuit boards and for interconnecting other types of devices, such as cables, to printed circuit boards. Sometimes, one or more smaller printed circuit boards may be connected to another larger printed circuit board. In such a configuration, the larger printed circuit board may be called a "mother board" and the printed circuit boards connected to it may be called daughterboards. Also, boards of the same size or similar sizes may sometimes be aligned in parallel. Connectors used in these applications are often called "stacking connectors" or "mezzanine connectors."

Regardless of the exact application, electrical connector designs have been adapted to mirror trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

In a high density, high speed connector, electrical conductors may be so close to each other that there may be electrical interference between adjacent signal conductors. To reduce interference, and to otherwise provide desirable electrical properties, shield members are often placed between or around adjacent signal conductors. The shields may prevent signals carried on one conductor from creating "crosstalk" on another conductor. The shield may also impact the impedance of each conductor, which may further contribute to desirable electrical properties.

Examples of shielding can be found in U.S. Pat. Nos. 4,632,476 and 4,806,107, which show connector designs in which shields are used between columns of signal contacts. These patents describe connectors in which the shields run parallel to the signal contacts through both the daughterboard connector and the backplane connector. Cantilevered beams are used to make electrical contact between the shield and the backplane connectors. U.S. Pat. Nos. 5,433,617, 5,429,521, 5,429,520, and 5,433,618 show a similar arrangement, although the electrical connection between the backplane and shield is made with a spring type contact. Shields with torsional beam contacts are used in the connectors described in U.S. Pat. No. 6,299,438. Further shields are shown in U.S. Pre-grant Publication 2013-0109232.

Other connectors have the shield plate within only the daughterboard connector. Examples of such connector designs can be found in U.S. Pat. Nos. 4,846,727, 4,975,084, 5,496,183, and 5,066,236. Another connector with shields only within the daughterboard connector is shown in U.S. Pat. No. 5,484,310. U.S. Pat. No. 7,985,097 is a further example of a shielded connector.

Other techniques may be used to control the performance of a connector. For instance, transmitting signals differentially may also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals. Examples of differential electrical connectors are shown in U.S. Pat. Nos. 6,293,827, 6,503,103, 6,776,659, 7,163,421, and 7,794,278.

Another modification made to connectors to accommodate changing requirements is that connectors have become much larger in some applications. Increasing the size of a connector may lead to manufacturing tolerances that are much tighter. For instance, the permissible mismatch between the conductors in one half of a connector and the receptacles in the other half may be constant, regardless of the size of the connector. However, this constant mismatch, or tolerance, may become a decreasing percentage of the connector's overall length as the connector gets longer. Therefore, manufacturing tolerances may be tighter for larger connectors, which may increase manufacturing costs. One way to avoid this problem is to use connectors that are constructed from modules to extend the length of the connector. Teradyne Connection Systems of Nashua, N.H., USA pioneered a modular connector system called HD+®. This system has multiple modules, each having multiple columns of signal contacts, such as 15 or 20 columns. The modules are held together on a metal stiffener to enable construction of a connector of any desired length.

Another modular connector system is shown in U.S. Pat. Nos. 5,066,236 and 5,496,183. Those patents describe "module terminals" each having a single column of signal contacts. The module terminals are held in place in a plastic housing module. The plastic housing modules are held together with a one-piece metal shield member. Shields may be placed between the module terminals as well.

BRIEF SUMMARY

Some aspects of the present application relate to an electrical connector. The electrical connector may comprise a plurality of signal conductors disposed in a plurality of columns, each of the plurality of signal conductors comprising a mating contact portion and an intermediate portion, the mating contact portions being elongated in a first direction, and the plurality of signal conductors being disposed in a plurality of groups, each of the plurality of groups comprising at least one signal conductor of the plurality of signal conductors. The electrical connector may further comprise a housing comprising a first portion holding the intermediate portions of the plurality of signal conductors, wherein the housing comprises a plurality of projections extending in the first direction from the first portion with openings between adjacent projections of the plurality of projections; and wherein the projections are disposed adjacent the mating contact portions of the plurality of signal conductors such that, for each of the plurality of groups, there is at least one of the plurality of projections and at least one of the openings adjacent the mating contact portions of the signal conductors of the group.

Further aspects of the present application relate to an electrical connector. The electrical connector may comprise a plurality of signal conductors disposed in a plurality of columns, each of the plurality of signal conductors comprising a receptacle and an intermediate portion, the receptacle being elongated in a first direction, and the plurality of signal conductors being disposed in a plurality of groups, each of the plurality of groups comprising at least one signal conductor of the plurality of signal conductors. The electrical connector may further comprise a housing comprising a first portion holding the intermediate portions of the plurality of signal conductors, wherein the housing comprises a plurality of projections extending in the first direction from the first portion with openings between adjacent projections of the plurality of projections; and wherein the projections extend beyond the receptacle of the plurality of signal conductors such that, for each of the plurality of groups, there is at least one of the plurality of projections and at least one of the openings extending beyond receptacles of the signal conductors of the group.

Further aspects of the present application relate to a method for connecting a first electrical connector having a first housing, the first housing comprising a first plurality of projections extending along a mating direction and a first plurality of mating contact portions disposed in a first plurality of columns, with a second electrical connector having a second housing, the second housing comprising a second plurality of projections extending along the mating direction and a second plurality of mating contact portions disposed in a second plurality of columns. The method may comprise positioning the first electrical connector in proximity to the second electrical connector such that the first plurality of projections overlap, at least in part, with the second plurality of projections with respect to a plane that is perpendicular to the mating direction; and sliding, along the mating direction, the first electrical connector toward the second electrical connector until each of the first plurality of mating contact portions of a first column of the first plurality of first columns is in electrical contact with one of the second plurality of mating contact portions of a second column of the second plurality of columns, and until each of the second plurality of projections is engaged with a first opening formed between adjacent first projections of the first plurality of projections and each of the first plurality of projections is engaged with a second opening formed between adjacent second projections of the second plurality of projections.

Additional aspects of the present application relate to an electrical connector. The electrical connector may comprise a signal conductor comprising a mating contact portion and an intermediate portion, the mating contact portion being elongated in a first direction; a housing comprising a first portion holding the intermediate portion, wherein the housing comprises one or more projections extending in the first direction from the first portion with one or more openings, such that each opening is adjacent a projection of the one or more projections; and wherein the one or more projections are disposed adjacent the mating contact portion.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF PREFERRED EMBODIMENTS

Figure 1B:
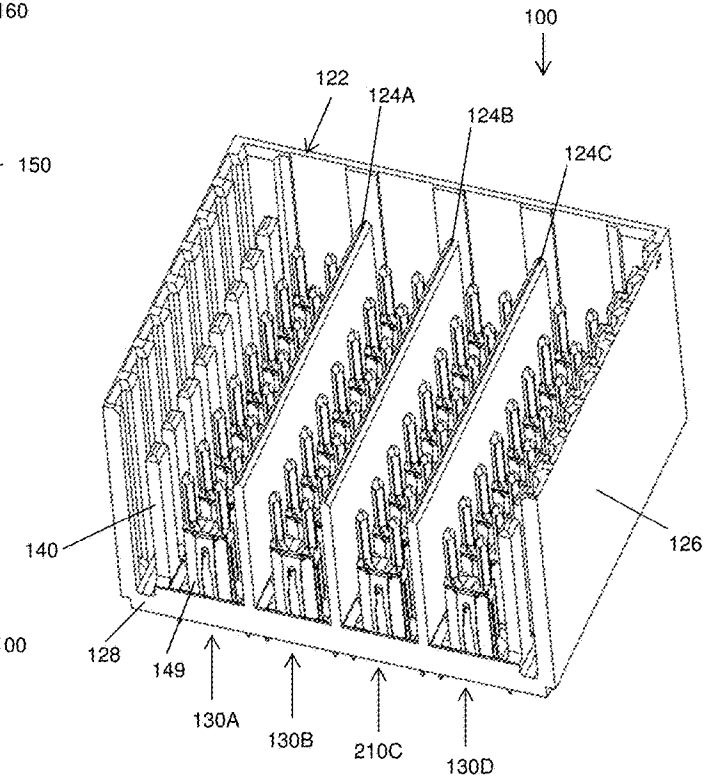
FIG. 1B is an isometric view, partially cutaway, of the backplane connector of FIG. 1, in accordance with some embodiments.

The inventors have recognized and appreciated that performance of a high density interconnection system, particularly those that carry very high frequency signals that are necessary to support high data rates, may be increased with designs that reduce effects of impedance discontinuities associated with variable separation of separable components that form a mating interface. Such impedance discontinuities may create signal reflections that increase near end cross talk, attenuate signals passing through the interconnect, cause electromagnetic radiation that gives rise to far end cross talk or otherwise degrades signal integrity.

Separable electrical connectors are used herein as an example of an interconnection system. The mating interfaces of some electrical connectors have been designed such that the impedance of signal conductors through a mating region, when the connectors are in a designed mating position, matches the impedance of intermediate portions of those signal conductors within the components. For low density interconnects, such as coaxial connectors that have a single signal conductor, it may be possible to construct and operate the mating connectors such that the designed mating position is reliably achieved. Greater design flexibility in choice of material or shaping and positioning of components to avoid impedance discontinuities is possible with such low density connectors.

However, for high density interconnects having multiple signal conductors, it is difficult to achieve a designed mating position for all of the signal conductors simultaneously. Additionally, the constraints imposed by meeting mechanical requirements to accurately position numerous signal conductors, with appropriate grounding and shielding in a small volume, forecloses many design techniques that might be used in cables or in connectors that connect one or a small number of signal conductors. For example, a high density connector may have an array of signal conductors spread out over a connector length of 6 inches or more. Such connectors may have a width on the order of an inch or more, providing hundreds of signal conductors to be mated at a separable interface. Normal manufacturing tolerances of the connectors may preclude all the signal conductors mating in the designed mating position over such a wide area, because, when some portions of one connector press against a mating connector, other portions of the connectors may still be separated.

The force required to press the connectors together may also lead to variability in the separation between connectors, such that all portions of the connector are not in the designed mating position. The force required to push the connectors together increases in proportion to the number of signal conductors that mate. For a high density connector with numerous signal conductors, the force may be on the order of tens of pounds or more. An interconnection system may be designed, relying on human action to press components together in way that generates the required mating force. However, because of variability in the way an operator assembles the system or many other possible factors, the required force may not always be generated when connectors are mated, such that the connectors are not fully pressed together in practice.

Further contributing to variability in separation of connectors, the level of force needed to force the connectors fully together may also create flex in the substrates, such as printed circuit boards, to which the connectors are attached. A printed circuit board, for example, may flex more at the center than the ends, and portions of the connectors mounted near the middle of a printed circuit board may be separated more than portions of the connectors near the sides of the printed circuit board.

To accommodate for the components mating in other than the designed mating position, many high density connectors are designed to have a "functional mating range" of approximately 2-5 mm. "Functional mating range" means the amount that one conductive element is designed to slide over a mating conductive element to reach a designed mating position from a point where the conductive elements engage with sufficient normal force to provide a reliable connection. In many embodiments, the connectors are fully pressed-together in the designed mating position, and a fully pressed together position is used as an example of a designed mating position herein.

Because sliding the contacts relative to one another can remove oxide or contamination on the mating contacts, some portion of the functional mating range provides "wipe," which is desirable because sliding conductive elements in contact can remove contaminants from the mating contact portions and make a more reliable connection. However, the functional mating range in a high density connector is typically larger than needed for "wipe". In high density connectors, the functional mating range provides the additional benefit of enabling the mating signal conductors to be in electrical contact, even when the connector components are separated by a distance up to the amount of the "functional mating range."

The inventors have recognized and appreciated a problem with designing connectors, particularly very high speed, high density connectors, with a large functional mating range. Conventionally, connectors designed to accommodate mating at any point over a range of positions, particularly when operated at high frequencies, provide signal paths with variations in impedance, whether those variations are relative to a nominal designed value or are variations along the length of the signal conductors, or both.

If the mating connectors are separated by less than the amount of "functional mating range" supported by the connector, the conductive elements of the mating connectors should make electrical contact at some point in the mating region, which is desired. However, when mated at that point, the signal conductors may not have the same relative position to other portions of the connector that they would in a fully mated position, which may impact impedance.

For example, spacing between signal conductors in one connector and reference conductors or dielectric material in a mating electrical connector can affect impedance of the signal conductors. When there is variation in spacing between the connectors, there may also be variation in spacing between the signal conductors in one connector and these other structures that are in an impedance affecting position. Thus, the impedance may vary depending on the separation between the mating connectors.

When the connectors are separated, portions of the signal conductors may not be surrounded by material with the same effective dielectric constant as when the connectors are pressed fully together. Likewise, the separation between signal conductors and adjacent ground conductors may be different than when the connectors are pressed fully together. As a result, when the connectors are separated, though still close enough together to be within the functional mating range, the impedance of the signal conductors within the mating region may be different than the designed impedance, and the resulting impedance may depend on the amount of separation between the components.

The impedance in the mating region may result from a signal path geometry in which portions of the interconnection system are positioned as designed, while other portions are displaced from their designed positions. One such difference results from a different effective dielectric constant of material surrounding signal conductors when two components are fully pressed together relative to when there is separation between the components.

For example, portions of signal conductors may pass through regions in which the signal conductors are surrounded by dielectric structures that are part of the same connector such that, regardless of the relative separation between two connectors, the relative position of the signal conductors and these structures is preserved. When dielectric material is between the signal conductors and adjacent reference conductors, the dielectric may affect impedance. A fixed relationship of signal conductor, reference conductor and dielectric, for example, may occur for the intermediate portions of signal conductors in a connector module in which the signal conductor is embedded in a dielectric portion to which reference conductors are attached.

In the mating region, however, at least portions of the conductive elements must be exposed to make electrical connection to mating contact portions in a mating module. These structures might not be surrounded by dielectric members that form a portion of the same module as the signal conductor. When two mating connectors are fully pressed together, the extending mating contact portions of one connector may be inserted into the mating contact portions of another connector. In this configuration, the impedance of the signal path through the mating contact portion may be impacted by the relative positioning of a signal conductor in one module and an adjacent reference conductor or dielectric material from the mating connector.

In a conventional connector design, when there is separation between the mating connectors, the portion of the mating contact portion of one connector that relies on structures in the mating connector to achieve a desired impedance will not be in the designed position with respect to these impedance affecting structures in the mating connector. As a result, separation between the connectors will lead to an impedance in that region different than the designed impedance. This impedance may vary based on the amount of separation, introducing greater variability.

For example, two connectors may have mating interface surfaces that butt together when the connectors are fully mated. A mating contact portion extending from one connector may have an impedance that varies along its length, with different impedance in different regions. The impedance of that signal path within the connector, up to the mating interface surface of that connector, may be controlled to have a nominal value based on values of design parameters within that connector. The mating interface of the connector may be designed such that, when the dielectric portions butt against one another, the impedance has a value such as 50, 85 or 100 Ohms or other suitable value, in order to match the impedance in other portions of the interconnection system. Likewise, the impedance of the signal path for the portion of the extending contact that extends through the mating interface surface of the mating connector may be controlled to have the nominal value based on values of design parameters within the mating connector.

However, any portion of the signal path between the two mating interface surfaces may have an impedance that differs from the nominal value. Such a portion of the signal path may exist as a result of separation between the connectors, which deviates from a designed separation for the fully mated connectors. In this region, there may be no dielectric members or reference conductors placed in an impedance affecting position with respect to the signal conductor. Frequently, the material surrounding the mating contact portions is air. In contrast to the insulator used in forming the connector housing that may have a relative dielectric constant in the range of 2-4, for example. For comparison, air has a relative dielectric constant that is close to 1. As a result, a signal conductor designed to have a nominal impedance when passing through a dielectric housing, may have a different impedance when passing through air, meaning that a signal conductor may have a different impedance between the mating interface surfaces than within the housing of either connector. As defined herein, "relative dielectric constant", or simply "dielectric constant", will refer to the relative permittivity of a material, expressed as the ratio of the dielectric permittivity of the material relative to the dielectric permittivity of vacuum.

Other design parameters may lead to a different impedance along a signal path in the region between mating interface surfaces than within the connectors. For example, reference conductors positioned to provide a nominal impedance within the connector housings may have a different spacing relative to the signal conductor in the region between the mating interface surfaces than within the connector housing. Because the impedance of a signal conductor may depend on the separation between the signal conductor and an adjacent reference conductor, different spacing in one region than another may result in a change in impedance along the signal path from one region to another. For a conventional high speed, high density connector, in which the reference conductors are fixed to the connectors, this spacing between signal and reference conductors, and therefore impedance, in the region between the mating interface surfaces, will be different when the connectors are fully mated than when separated.

The fact that impedance in the mating region is impacted by separation between components means that, particularly for high speed connectors that have been designed to have a uniform impedance in the intermediate portions and through the mating region, when the components are not in their designed mating positions, there will be a change in impedance along the length of each signal conductor. The impedance in at least a portion of the mating region will be different than in the intermediate portion, where impedance is dictated by structures within each connector, and is unaffected by the amount of separation between components.

The impact of a change in impedance may depend on the amount of separation between the components or the operating frequency range of the connector. For a small separation, or for a low frequency signal, such a change in impedance may have no discernible performance impact. At low frequencies, a separation, even if equal to the full functional mating range of the connector, may give rise to a very small difference in impedance relative to the intermediate portions of the signal conductors that are within the connector housings. Moreover, at lower frequencies, such a change in impedance may be effectively averaged along the length of the signal paths through the interconnection system such that the change in impedance has little impact.

At higher frequencies, however, the change in impedance associated with separation of the connectors may be more significant, to the point of limiting performance of the connector. Such an impact may result because the difference in impedance, caused by the separation, between a mating region and the intermediate portions of the signal conductors is greater at higher frequencies. Moreover, at higher frequencies, a change in impedance attributable to separation of the components presents a localized impedance discontinuity rather than a change that is averaged over the length of the entire signal conductor. For example, in a high-speed interconnection system, a connector may be designed such that a fully mated connector may provide an impedance in the mating region that differs from the impedance in the intermediate portion by 3 ohms or less at the higher range of operating frequencies of the connector. However, when the mating connectors are separated by up to the length of the functional mating range, the impedance difference between portions of the signal conductors in the mating region and the intermediate portions of the signal conductors may differ by two, three or more times the intended difference. This difference between the actual impedance of signal conductors and designed impedance may give rise to signal integrity problems, depending on the frequency range of interest.

The frequency range of interest may depend on the operating parameters of the system in which such a connector is used, but may generally have an upper limit between about 15 GHz and 50 GHz, such as 25 GHz, 30 or 40 GHz, although higher frequencies or lower frequencies may be of interest in some applications. Some connector designs may have frequency ranges of interest that span only a portion of this range, such as 1 to 10 GHz or 3 to 15 GHz or 5 to 35 GHz. The impact of variations in impedance may be more significant at these higher frequencies.

The operating frequency range for an interconnection system may be determined based on the range of frequencies that can pass through the interconnection with acceptable signal integrity. Signal integrity may be measured in terms of a number of criteria that depend on the application for which an interconnection system is designed. Some of these criteria may relate to the propagation of the signal along a single-ended signal path, a differential signal path, a hollow waveguide, or any other type of signal path. Two examples of such criteria are the attenuation of a signal along a signal path or the reflection of a signal from a signal path.

Other criteria may relate to interaction of multiple distinct signal paths. Such criteria may include, for example, near end cross talk, defined as the portion of a signal injected on one signal path at one end of the interconnection system that is measurable at any other signal path on the same end of the interconnection system. Another such criterion may be far end cross talk, defined as the portion of a signal injected on one signal path at one end of the interconnection system that is measurable at any other signal path on the other end of the interconnection system.

As specific examples, it could be required that signal path attenuation be no more than 3 dB power loss, reflected power ratio be no greater than −20 dB, and individual signal path to signal path crosstalk contributions be no greater than −50 dB. Because these characteristics are frequency dependent, the operating range of an interconnection system is defined as the range of frequencies over which the specified criteria are met.

Accordingly, the inventors have recognized and appreciated the desirability of using techniques in separable interfaces of high speed, high density interconnection systems to reduce the impact of changes in impedance attributable to variable separation of components that form the interface. Such techniques may provide an impedance in the mating region that is independent of separation between the separable components. Alternatively or additionally, such techniques may provide an impedance that varies smoothly over the mating region, regardless of separation between the separable components, to avoid discontinuities of a magnitude that impact performance.

Designs that reduce or eliminate impedance discontinuities or the effects of discontinuities in the mating region, regardless of separation between components, such as may be achieved by selection of the shape and/or position of one or more conductive elements and/or dielectric elements. In accordance with some techniques, impedance control may be provided by members, projecting from one connector, partially or fully through the space separating and/or adjacent the mating connectors. Accordingly, these members may have dimensions that are on the order of the functional mating range of the connector, such as 1-3 mm or, in some embodiments, at least 2 mm. These projecting members may be dielectric and/or conductive. Accordingly, these members will be positioned within the space between, or adjacent to, connectors when the connectors are demated by the functional mating range. When the connectors are separated by less than the functional mating range, the projecting members of one connector may project into the mating connector.

The projecting members may be positioned to reduce or substantially eliminate changes in impedance associated with variable separation of connectors. Such a result may be achieved by having the projecting members in an impedance affecting relationship with the signal conductors in the mating region between the connectors, when the connectors are separated. The shape and position of the projecting members may be such that the impedance of the signal conductors in this mating region provides a desired impedance, regardless of separation between the connectors. The connector may be designed such that the projecting member does not impact the impedance in either connector, regardless of separation between the connectors.

For example, the projecting members may be conductive and may be configured as reference conductors. In some embodiments, the conductive members may be configured to provide a nominal impedance within the connector to which they are attached, but to have little or no impact on the impedance in the other connector, regardless of the separation between connectors. Such a result may be achieved by having the projecting member adjacent to a reference conductor in that connector such that, regardless of the amount of separation between connectors, there is no significant difference in the distance between the signal conductors in that connector and the nearest reference conductor.

In contrast, the projecting member may be shaped and positioned to impact impedance along the signal path between connectors. For example, in the region between the mating connectors when separated, the projecting members may be shaped and positioned to provide a spacing between signal conductors and reference conductors that, in combination with other parameters, provides the nominal impedance in that region. Such other parameters may include thickness or shape of the signal conductor and dielectric constant of material in that region.

The projecting members may alternatively or additionally be dielectric, and may be formed, for example, from dielectric material of the type forming a connector housing. The dielectric projecting member may be shaped and positioned to lessen the impact of changes in impedance that might arise from separation of the connectors by distributing those changes across the mating interface region of the connector. For example, the dielectric projecting member from one connector may extend into an impedance affecting position with respect to a signal conductor in a mating connector when the connectors are fully mated. When partially demated, that dielectric projecting member will not extend all the way into the mating connector, occupying less of the impedance affecting position, and leaving a region with a void. Because the void may fill with air, separation means that more air is in an impedance affecting position with respect to the signal conductor within that connector, lowering the effective dielectric constant and impacting impedance in that region.

That dielectric projecting member, if it does not extend fully into the connector as a result of separation between the connectors, instead fills at least a portion of the space between the two connectors, thereby replacing air that might otherwise exist in that separation with a dielectric member. As a result, the projecting member raises the effective dielectric constant in the space between connectors, relative to what it would have been had the space been entirely filled with air. Because this dielectric constant is closer to what would be experienced had the entire signal conductor been within a connector housing, such as occurs when there is no separation between the connectors, the magnitude of any change in impedance as a result of separation is less than had the entire space been filled with air.

Moreover, the impact of the separation between the connectors is spread over a longer distance. Changes in the amount of dielectric material in impedance affecting positions impact both the impedance along a signal path in the space between the connectors as well as within one of the connectors. By distributing changes in impedance over a greater distance along the signal path, the abruptness of the change in impedance at any given location may be less, and the impact of that change may likewise be less.

Designs of an electrical connector are described herein that improve signal integrity for high frequency signals, such as at frequencies in the GHz range, including up to about 25 GHz or up to about 40 GHz or higher, while maintaining high density, such as with a spacing between adjacent mating contacts on the order of 2 mm or less, including center-to-center spacing between adjacent contacts in a column of between 0.75 mm and 1.85 mm or between 1 mm and 1.75 mm, for example. Spacing between columns of mating contact portions may be similar, although there is no requirement that the spacing between all mating contacts in a connector be the same.

Figure 1A:
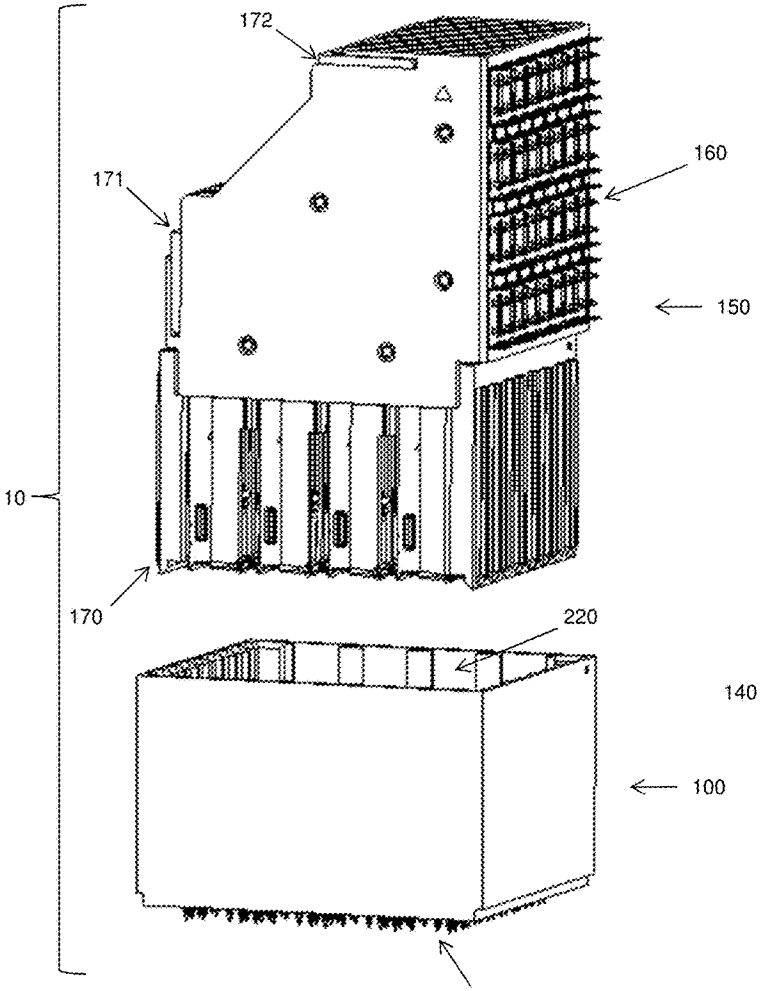
FIG. 1A is an isometric view of an exemplary electrical interconnection system, in accordance with some embodiments.

FIG. 1A illustrates an electrical interconnection system of the form that may be used in an electronic system. In this example, electrical interconnection system 10 includes a right angle connector and may be used, for example, in electrically connecting a daughtercard to a backplane. These figures illustrate two mating connectors. In this example, connector 100 is designed to be attached to a backplane and connector 150 is designed to attach to a daughtercard. As can be seen in FIG. 1A, daughtercard connector 150 includes contact tails 160 designed to attach to a daughtercard (not shown). Backplane connector 100 includes contact tails 110, designed to attach to a backplane (not shown). These contact tails form one end of conductive elements that pass through the interconnection system. When the connectors are mounted to printed circuit boards, these contact tails will make electrical connection to conductive structures within the printed circuit board that carry signals or are connected to a reference potential.

Each of the connectors also has a mating interface where that connector can mate—or be separated from—the other connector. Daughtercard connector 150 includes a mating interface 170. Backplane connector 100 includes a mating interface 220. Though not fully visible in the view shown in FIG. 1A, mating contact portions of the conductive elements are exposed at the mating interface.

Each of these conductive elements includes an intermediate portion that connects a contact tail to a mating contact portion. The intermediate portions may be held within an intermediate portion of a connector housing, at least a portion of which may be dielectric so as to provide electrical isolation between conductive elements. Additionally, the connector housings may include conductive or lossy portions, which in some embodiments may provide conductive or partially conductive paths between some of the conductive elements. In some embodiments, the conductive portions may provide shielding. The lossy portions may also provide shielding in some instances and/or may provide desirable electrical properties within the connectors.

In various embodiments, dielectric members may be molded or over-molded from a dielectric material such as plastic or nylon. Examples of suitable materials include, but are not limited to, liquid crystal polymer (LCP), polyphenyline sulfide (PPS), high temperature nylon or polypropylene (PPO). Other suitable materials may be employed, as aspects of the present disclosure are not limited in this regard.

All of the above-described materials are suitable for use as binder material in manufacturing connectors. In accordance some embodiments, one or more fillers may be included in some or all of the binder material. As a non-limiting example, thermoplastic PPS filled to 30% by volume with glass fiber may be used to form the entire connector housing or dielectric portions of the housings.

Alternatively or additionally, portions of the housings may be formed of conductive materials, such as machined metal or pressed metal powder. In some embodiments, portions of the housing may be formed of metal or other conductive material with dielectric members spacing signal conductors from the conductive portions. In the embodiment illustrated, for example, a housing of backplane connector 100 may have regions formed of a conductive material with insulative members separating the intermediate portions of signal conductors from the conductive portions of the housing.

The housing of daughtercard connector 150 may also be formed in any suitable way. In the embodiment illustrated, daughtercard connector 150 may be formed from multiple subassemblies, referred to herein as "wafers." Each of the wafers (FIG. 1C) may include a housing portion, which may similarly include dielectric, lossy and/or conductive portions. One or more members may hold the wafers in a desired position. For example, support members 171 and 172 may hold top and rear portions, respectively, of multiple wafers in a side-by-side configuration. Support members 171 and 172 may be formed of any suitable material, such as a sheet of metal stamped with tabs, openings or other features that engage corresponding features on the individual wafers.

Other members that may form a portion of the connector housing may provide mechanical integrity for daughtercard connector 150 and/or hold the wafers in a desired position. For example, a front housing portion may receive portions of the wafers forming the mating interface. Any or all of these portions of the connector housing may be dielectric, lossy and/or conductive, to achieve desired electrical properties for the interconnection system.

In some embodiments, each wafer may hold a column of conductive elements forming signal conductors. These signal conductors may be shaped and spaced to form single ended signal conductors. However, in the embodiment illustrated in FIG. 1A, the signal conductors are shaped and spaced in pairs to provide differential signal conductors. Each of the columns may include or be bounded by conductive elements serving as ground conductors. It should be appreciated that ground conductors need not be connected to earth ground, but are shaped to carry reference potentials, which may include earth ground, DC voltages or other suitable reference potentials. The "ground" or "reference" conductors may have a shape different than the signal conductors, which are configured to provide suitable signal transmission properties for high frequency signals.

Conductive elements may be made of metal or any other material that is conductive and provides suitable mechanical properties for conductive elements in an electrical connector. Phosphor-bronze, beryllium copper and other copper alloys are non-limiting examples of materials that may be used. The conductive elements may be formed from such materials in any suitable way, including by stamping and/or forming.

The spacing between adjacent columns of conductors is not critical. However, a higher density may be achieved by placing the conductors closer together. As a non-limiting example, the conductors may be stamped from 0.4 mm thick copper alloy, and the conductors within each column may be spaced apart by 2.25 mm and the columns of conductors may be spaced apart by 2 mm. However, in other embodiments, smaller dimensions may be used to provide higher density, such as a thickness between 0.2 and 0.4 mm or spacing of 0.7 to 1.85 mm between columns or between conductors within a column. Moreover, each column may include four pairs of signal conductors, such that a density of 60 or more pairs per linear inch is achieved for the interconnection system illustrated in FIG. 1A. However, it should be appreciated that more pairs per column, tighter spacing between pairs within the column and/or smaller distances between columns may be used to achieve a higher density connector.

The wafers may be formed in any suitable way. In some embodiments, the wafers may be formed by stamping columns of conductive elements from a sheet of metal and over molding dielectric portions on the intermediate portions of the conductive elements. In other embodiments, wafers may be assembled from modules each of which including a single, single-ended signal conductor, a single pair of differential signal conductors or any suitable number of single ended or differential pairs.

The inventors have recognized and appreciated that assembling wafers from modules may aid in reducing "skew" in signal pairs at higher frequencies, such as between about 25 GHz and 40 GHz, or higher. Skew, in this context, refers to the difference in electrical propagation time between signals of a pair that operates as a differential signal. Modular construction that reduces skew is described, for example in application 61/930,411, which is incorporated herein by reference.

In accordance with techniques described in that co-pending application, in some embodiments, connectors may be formed of modules, each carrying a signal pair. The modules may be individually shielded, such as by attaching shield members to the modules and/or inserting the modules into an organizer or other structure that may provide electrical shielding between pairs and/or ground structures around the conductive elements carrying signals.

In some embodiments, signal conductor pairs within each module may be broadside coupled over substantial portions of their lengths. Broadside coupling enables the signal conductors in a pair to have the same physical length. To facilitate routing of signal traces within the connector footprint of a printed circuit board to which a connector is attached and/or constructing of mating interfaces of the connectors, the signal conductors may be aligned with edge to edge coupling in one or both of these regions. As a result, the signal conductors may include transition regions in which coupling changes from edge-to-edge to broadside or vice versa. As described below, these transition regions may be designed to prevent mode conversion or suppress undesired propagation modes that can interfere with signal integrity of the interconnection system.

The modules may be assembled into wafers or other connector structures. In some embodiments, a different module may be formed for each row position at which a pair is to be assembled into a right angle connector. These modules may be made to be used together to build up a connector with as many rows as desired. For example, a module of one shape may be formed for a pair to be positioned at the shortest rows of the connector, sometimes called the a-b rows. A separate module may be formed for conductive elements in the next longest rows, sometimes called the c-d rows. The inner portion of the module with the c-d rows may be designed to conform to the outer portion of the module with the a-b rows.

This pattern may be repeated for any number of pairs. Each module may be shaped to be used with modules that carry pairs for shorter and/or longer rows. To make a connector of any suitable size, a connector manufacturer may assemble into a wafer a number of modules to provide a desired number of pairs in the wafer. In this way, a connector manufacturer may introduce a connector family for a widely used connector size, such as 2 pairs. As customer requirements change, the connector manufacturer may procure tools for each additional pair, or, for modules that contain multiple pairs, group of pairs to produce connectors of larger sizes. The tooling used to produce modules for smaller connectors can be used to produce modules for the shorter rows even of the larger connectors.

Further details of the construction of the interconnection system of FIG. 1A are provided in FIG. 1B, which shows backplane connector 100 partially cutaway. In the embodiment illustrated in FIG. 1B, a forward wall of housing 122 is cut away to reveal the interior portions of mating interface 220.

In the embodiment illustrated, backplane connector 100 also has a modular construction. Multiple pin modules 149 are organized to form an array of conductive elements. Each of the pin modules 149 may be designed to mate with a module of daughtercard connector 150.

In the embodiment illustrated, four rows and eight columns of pin modules 149 are shown. With each pin module having two signal conductors, the four rows 130A, 130B, 130C and 130D of pin modules create columns with four pairs or eight signal conductors, in total. It should be appreciated, however, that the number of signal conductors per row or column is not a limitation of the invention. A greater or lesser number of rows of pin modules may be include within housing 122. Likewise, a greater or lesser number of columns may be included within housing 122. Alternatively or additionally, housing 122 may be regarded as a module of a backplane connector, and multiple such modules may be aligned side to side to extend the length of a backplane connector.

In the embodiment illustrated in FIG. 1B, each of the pin modules 149 contains conductive elements serving as signal conductors. Those signal conductors are held within insulative members, which may serve as a portion of the housing backplane connector 100. The insulative portions of the pin modules 149 may be positioned to separate the signal conductors from other portions of housing 122. In this configuration, other portions of housing 122 may be conductive or partially conductive, such as may result from the use of lossy materials.

In some embodiments, housing 122 may contain both conductive and lossy portions. For example, a shroud including walls 126 and a floor 128 may be pressed from a powdered metal or formed from conductive material in any other suitable way. Pin modules 149 may be inserted into openings within floor 128.

Lossy or conductive members may be positioned adjacent rows 130A, 130B, 130C and 130D of pin modules 149. In the embodiment of FIG. 1B, separators 124A, 124B and 124C are shown between adjacent rows of pin modules. Separators 124A, 124B and 124C may be conductive or lossy, and may be formed as part of the same operation or from the same member that forms walls 126 and floor 128. Alternatively, separators 124A, 124B and 124C may be inserted separately into housing 122 after walls 126 and floor 128 are formed. In embodiments in which separators 124A, 124B and 124C formed separately from walls 126 and floor 128 and subsequently inserted into housing 122, separators 124A, 124B and 124C may be formed of a different material than walls 126 and/or floor 128. For example, in some embodiments, walls 126 and floor 128 may be conductive while separators 124A, 124B and 124C may be lossy or partially lossy and partially conductive.

In some embodiments, other lossy or conductive members may extend into mating interface 220, perpendicular to floor 128. Members 140 are shown adjacent to end-most rows 130A and 130D. In contrast to separators 124A, 124B and 124C, which extend across the mating interface 220, separator members 140, approximately the same width as one column, are positioned in rows adjacent row 130A and row 130D. Daughtercard connector 150 may include, in its mating interface 170, slots to receive, separators 124A, 124B and 124C. Daughtercard connector 150 may include openings that similarly receive members 140. Members 140 may have a similar electrical effect to separators 124A, 124B and 124C, in that both may suppress resonances, crosstalk or other undesired electrical effects. Members 140, because they fit into smaller openings within daughtercard connector 150 than separators 124A, 124B and 124C, may enable greater mechanical integrity of housing portions of daughtercard connector 150 at the sides where members 140 are received.

Figure 1C:
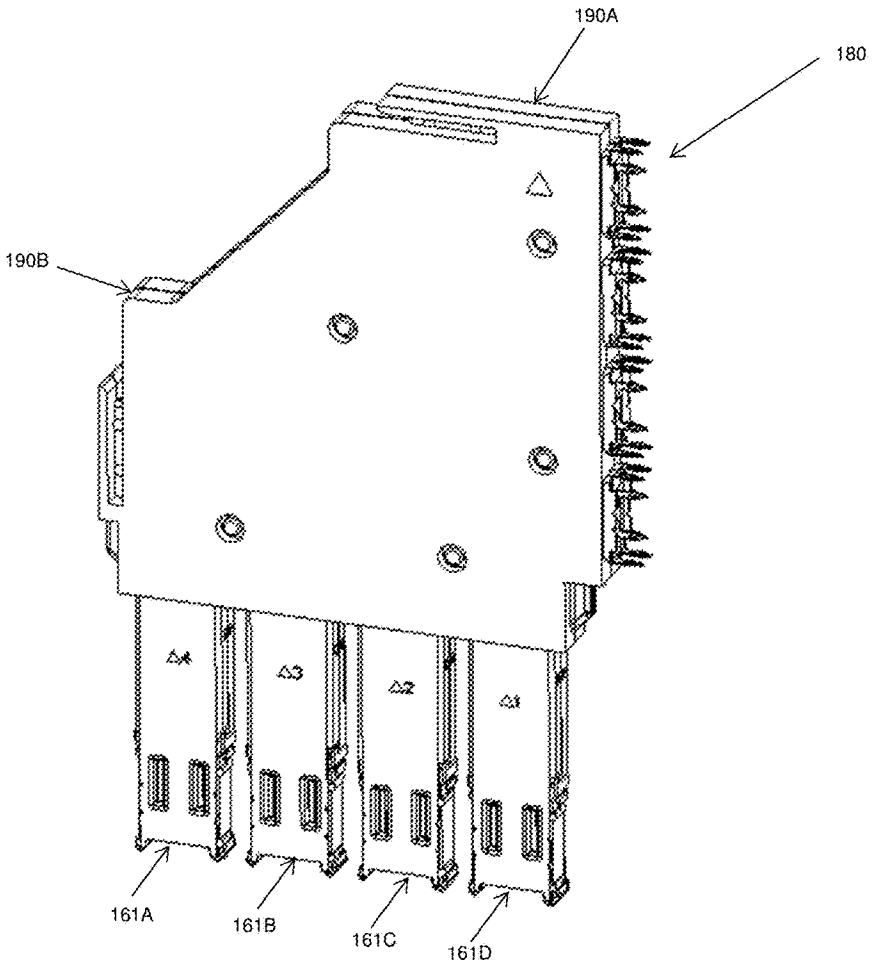
FIG. 1C is an isometric view of an exemplary wafer assembly of a daughtercard connector, in accordance with some embodiments.

FIG. 1C illustrates an exemplary wafer. Multiple such wafers may be aligned side-by-side and held together with one or more support members, or in any other suitable way, to form a daughtercard connector. In the embodiment illustrated, wafer 180 comprises multiple modules 161A, 161B, 161C and 161D. The modules are aligned to form a column of mating contact portions along one edge of wafer 180 and a column of contact tails along another edge of wafer 180. In the embodiment in which the wafer is designed for use in a right angle connector, as illustrated, those edges are perpendicular.

In the embodiment illustrated, each of the modules includes reference conductors that at least partially enclose the signal conductors. The reference conductors may similarly have mating contact portions and contact tails.

The modules may be held together in any suitable way. For example, the modules may be held within a housing, which in the embodiment illustrated is formed with members 190A and 190B. Members 190A and 190B may be formed separately and then secured together, capturing modules 161A . . . 161D between them. Members 190A and 190B may be held together in any suitable way, such as by attachment members that form an interference fit or a snap fit. Alternatively or additionally, adhesive, welding or other attachment techniques may be used.

Members 190A and 190B may be formed of any suitable material. That material may be an insulative material. Alternatively or additionally, that material may be or may include portions that are lossy or conductive. Members 190A and 190B may be formed, for example, by molding such materials into a desired shape. Alternatively, members 190A and 190B may be formed in place around modules 161A . . . 161D, such as via an insert molding operation. In such an embodiment, it is not necessary that members 190A and 190B be formed separately. Rather, a housing portion to hold modules 161A . . . 161D may be formed in one operation.

Figure 2:
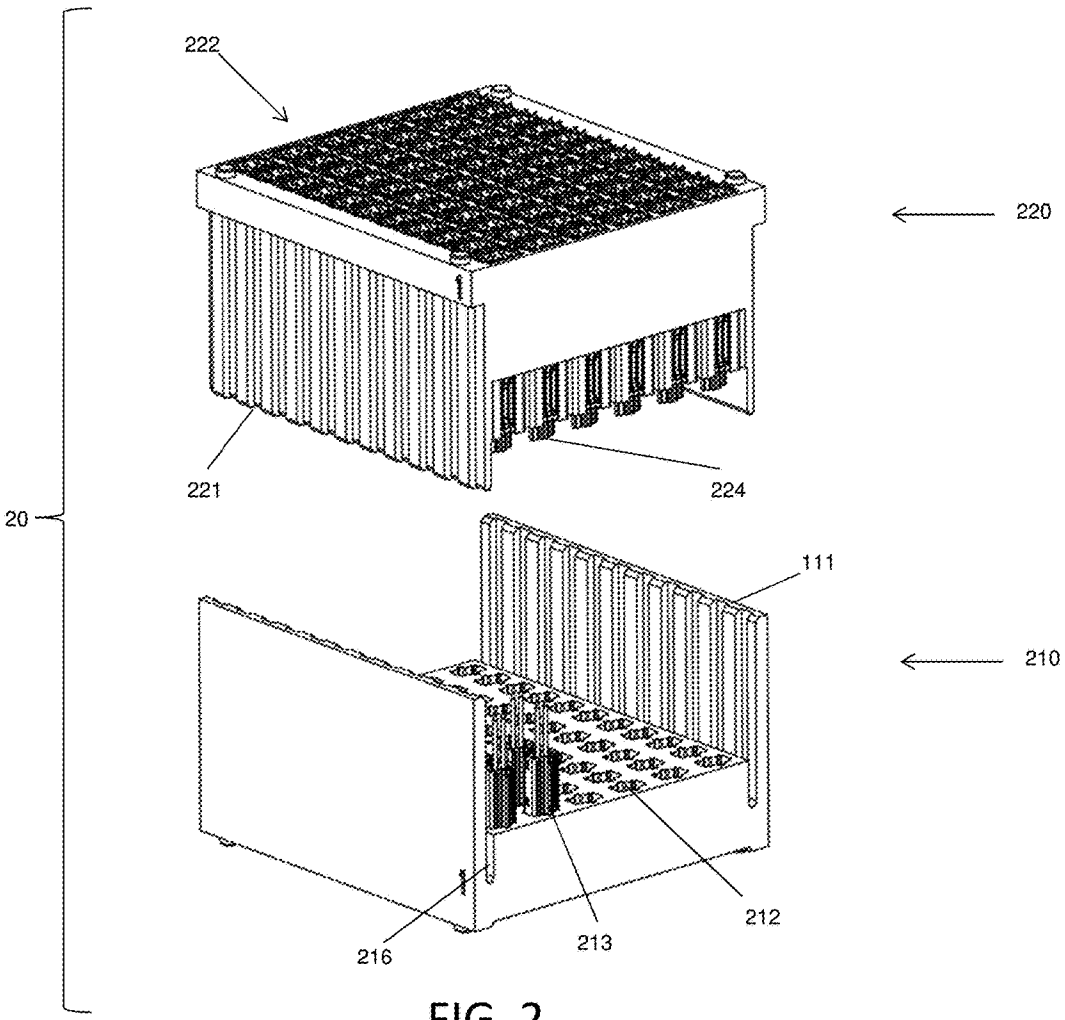
FIG. 2 is an isometric view of an exemplary mezzanine electrical interconnection system, in accordance with some embodiments.

FIG. 2 illustrates an alternative electrical interconnection system of the form that may be used in an electronic system. In this example, electrical interconnection system 20 may be configured to connect two parallel printed circuit boards in a stacking configuration, such as a backplane and a daughtercard. In some embodiments, connector 210 is designed to be attached to a backplane and connector 220 is designed to attach to a daughtercard. However the opposite configuration is also possible. Connector 220 may comprise contact tails 222 designed to attach to a daughtercard (not shown in FIG. 2). Connectors 220 and connectors 210 may be arranged in columns and rows. In the non-limiting example illustrated in FIG. 2, the connectors comprise eleven columns and six rows. However any other suitable number of columns and any other suitable number of rows may alternatively be used. Connector 210 may comprise a plurality of slots 212, where each slot may be configured to receive a module, such as module 213. In some embodiments, modules 213 may be disposed in slots 212 through press fit mechanisms, snap fit mechanisms or via any other suitable type of mechanism. In the example illustrated in FIG. 2, each module 213 comprises a pair of differential signal conductors. Alternatively, the modules may include a single, single-ended signal conductor, or any suitable number of single ended or differential pairs.

Connector 210 may be configured to mate with connector 220, such that each module disposed on connector 210 mates with a corresponding module 224 disposed on connector 220. Module 224 may comprise receptacles configured to mate with the signal conductors of module 213. Connector 210 may be disposed in a housing comprising two or more walls, such as wall 111, and connector 220 may be disposed in a housing comprising two or more walls, such as wall 221. Wall 111 may comprise a plurality of ribs formed on the inner surface of the wall, where the ribs may extend along the mating direction. Wall 221 may comprise a plurality of ribs formed on the outer surface of the wall, where the ribs may extend along the mating direction. When connector 220 is mated with connector 210, the ribs formed on wall 221 may slide in the grooves formed between adjacent ribs of wall 111. In some embodiments, the housing on which connector 210 is disposed may comprise a groove 216 formed on the floor of the housing and disposed adjacent a wall 111. In some embodiments, wall 221 may have a free end sticking out of the plane of modules 224. The free end of wall 221 may be configured to fit within groove 216 when the connectors are mated.

Figure 3A:
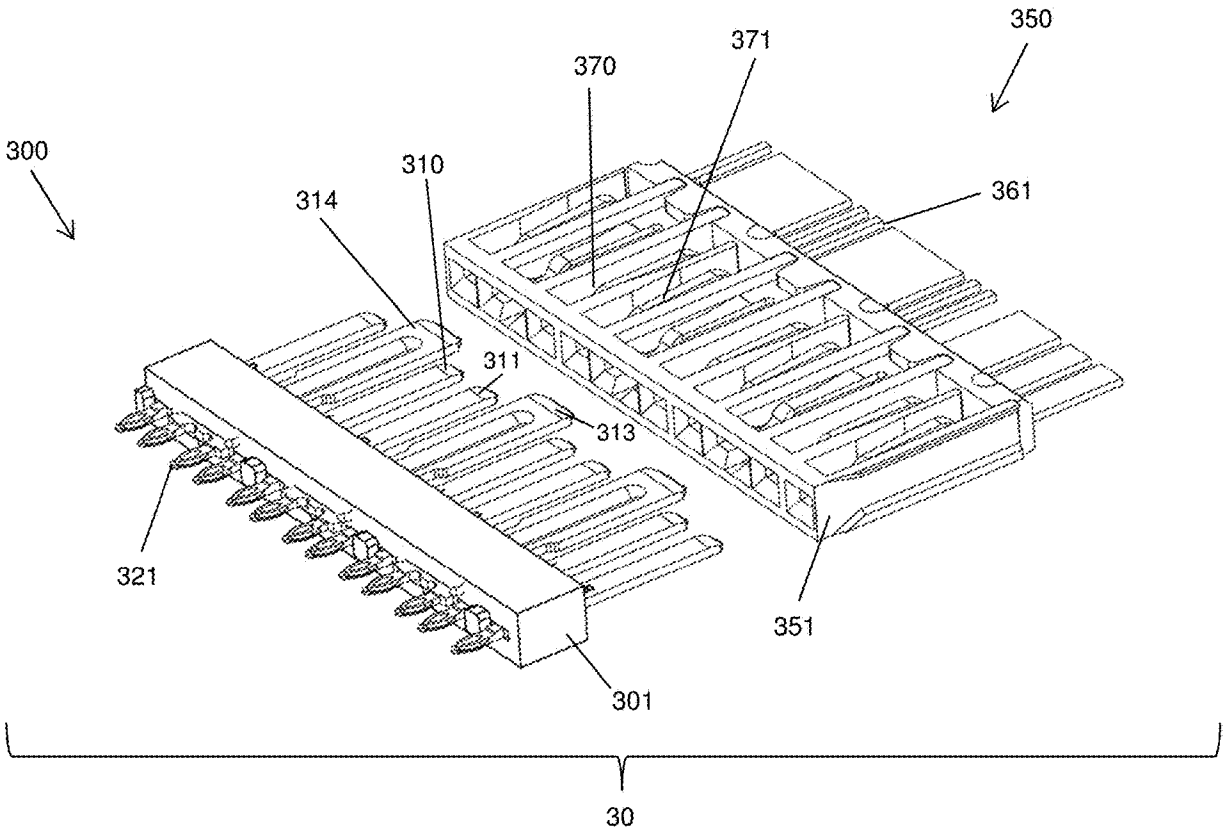
FIG. 3A is an isometric view of an illustrative electrical interconnection system in a demated position.

FIG. 3A illustrates an electrical interconnection system 30 shown in a demated position. Interconnection system 30 comprises module 300 and module 350. Multiple modules 300 and 350 may be assembled into a connector, in the same way that modules of FIGS. 1 and 2. Module 300 comprises a plurality of signal conductors configured to form electrical contacts with respective signal conductors disposed on module 350. In the example illustrated, module 300 comprises differential signal conductors 310 and 311, ground conductor 314 adjacent signal conductor 310 and ground conductor 313 adjacent signal conductor 311. The signal conductors extend through a surface of intermediate portion 301 of an insulative housing. Extending through the opposite surface of intermediate portion 301 are a plurality of contact tails, such as contact tail 321, shaped as press fit compliant sections. The conductors of module 300 extend along the mating direction. Module 350 comprise a housing 351 and a plurality of signal conductors configured to receive the conductors of module 300. Each conductor comprises an arm, acting as a beam to form a mating contact portion, extending along the mating direction. When the connectors are mated, each arm is configured to be deflected and to create an electrical connection with a respective conductor of module 300. Module 350 comprises a plurality of contact tails, such as contact tail 361.

Figure 3C:
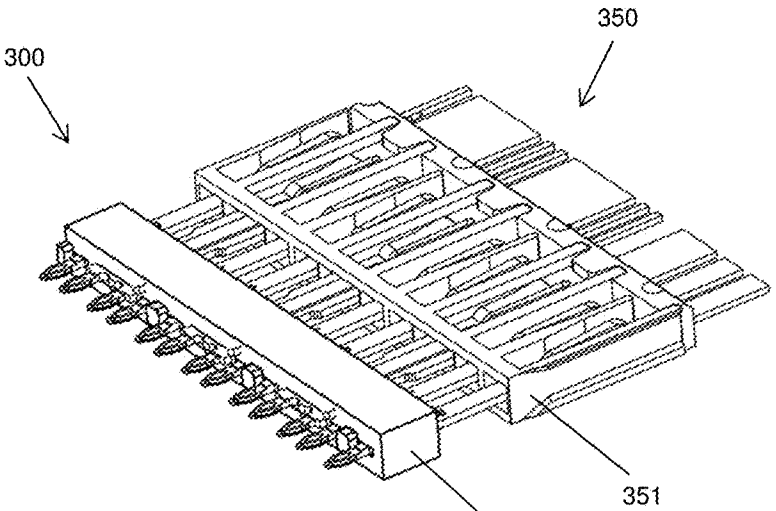
FIG. 3C PRIOR ART
FIG. 3C is an isometric view of the electrical interconnection system of FIG. 3A in a partially mated position.
Figure 3B:
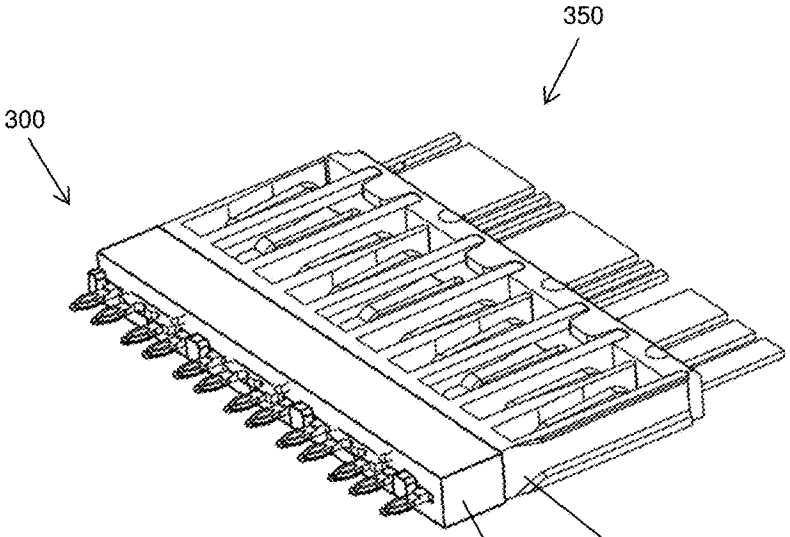
FIG. 3B is an isometric view of the electrical interconnection system of FIG. 3A in a fully mated position.

FIG. 3B illustrates electrical interconnection system 30 in a fully mated position. In such fully mated position, each conductor of module 300 is in contact with a conductor of module 350 and intermediate portion 301 abuts housing 351, such that the two portions are in contact to one another. FIG. 3C illustrates electrical interconnection system 30 in a partially mated position. In such position, the conductors of module 300 may partially contact the conductors of module 350, such that electrical connections are formed. However, intermediate portion 301 and housing 351 are not in contact with another and are separated by a distance within the functional mating range of electrical interconnection system 30.

While it is desirable to mate module 300 with module 350 to the position illustrated in FIG. 3B to ensure a uniform impedance along the signal path, sometimes such position is difficult to achieve. For example, a high density connector may have an array of modules 300 spread out over a connector length of 6 inches or more. Normal manufacturing tolerances of the connectors may preclude all the signal conductors mating in the designed mating position over such a wide area, because, when some portions of one connector press against a mating connector, other portions of the connectors may still be separated. The force required to press the connectors together may also lead to variability in the separation between connectors, such that all portions of the connector are not in the designed mating position.

Figure 4A:
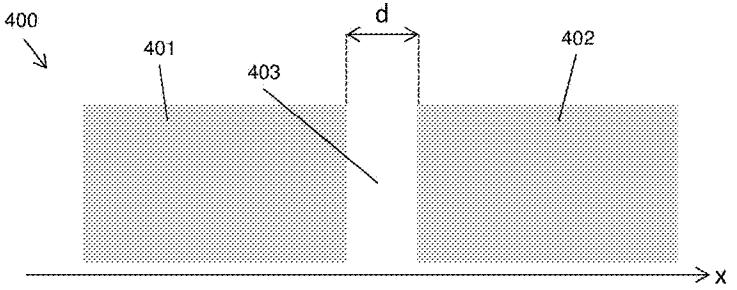
FIG. 4A is a schematic illustration of the mating region of an electrical interconnection system.

FIG. 4A is a schematic illustration of an electrical interconnection system 400, comprising a connector 401 and a connector 402. The connectors may be portions of respective modules such as modules 300 and 350 of FIG. 3A. In the example illustrated, connector 401 serves as intermediate portion 301 and connector 402 serves as housing 351. The connectors portions are separated by a distance d, less than the functional mating range, such that may be the case when modules 300 and 350 are partially mated as illustrated in FIG. 3C. Connector 401 and 402 may comprise one or more signal conductors (not shown in FIG. 4A). The signal conductors may extend across distance d so as to form electrical connections. Connector 401 and 402 may comprise a dielectric material, and separation region 403 may be filled with air.

Figure 4B:
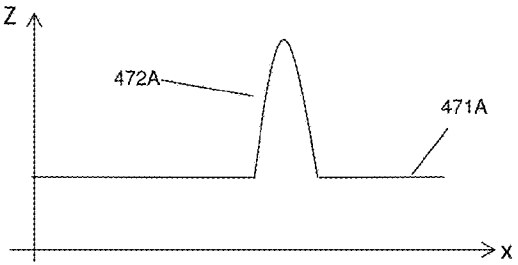
FIG. 4B is a plot showing impedance as a function of distance through the mating region of the electrical interconnection system of FIG. 4A.

FIG. 4B is a plot illustrating impedance (Z) along the signal path (x-axis) in the mating region of electrical interconnection system 400. In the region corresponding to connector 401, the impedance Z along the x-axis may be uniform and equal to a value represented on FIG. 4B as value 471A. The impedance may be uniform due to the fact that, within connector 401, the signal conductor may be completely surrounded by a material having a uniform dielectric constant. Because air has a dielectric constant that is less that the dielectric constant of connector 401, the signal conductor may experience a change in impedance within the separation region. As illustrated in FIG. 4B, the impedance may exhibit a peak 472A in the separation region 403. In the region corresponding to connector 402, the impedance may be equal to value 471A. Depending on distance d, the maximum of peak 472A may be several Ohms greater than value 471A, such as more than 10 or 20 Ohms. The abrupt variation in impedance may cause a signal propagating through electrical interconnection system 400 to experience significant reflections, attenuation, and/or radiation losses.

In accordance with some aspects of the present application, impedance control may be provided by members, projecting from one connector, partially or fully through the space separating and/or adjacent the mating connectors. These members may be positioned within the space between, or adjacent to, connectors when the connectors are demated by the functional mating range. When the connectors are separated by less than the functional mating range, the projecting members of one connector may project into the mating connector. The projecting members, also defined herein as "projections" may be positioned to reduce or substantially eliminate changes in impedance associated with variable separation of connectors.

Figure 4C:
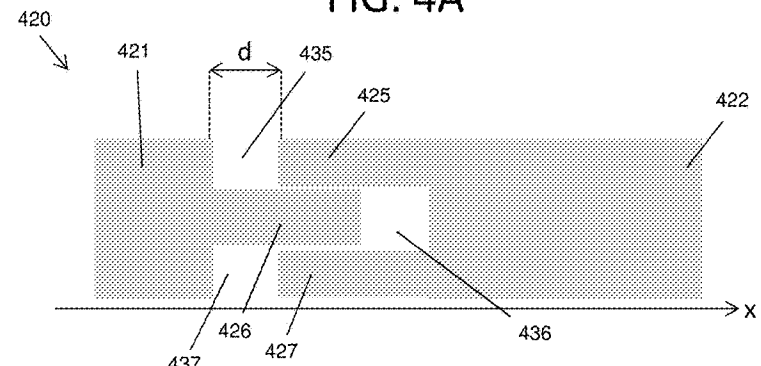
FIG. 4C is a schematic illustration of the mating region of an electrical interconnection system having at least one projection, in accordance with some embodiments.

FIG. 4C is a schematic illustration of an electrical interconnection system 420 comprising a plurality of projecting members, in accordance with some embodiments. Electrical interconnection system 420 may comprise connector 421 and connector 422. The connectors may be separated by a distance d less than the functional mating region of electrical interconnection system 420. Connector 421 may comprise one or more projecting members, such as projecting member 426. The projecting member(s) may extend along the mating direction (the x-axis), and may have a first end attached to connector 421, and a second free end extending away from connector 421. Connector 422 may comprise one or more projecting members, such as projecting members 425 and 427. The projecting member(s) may extend along the mating direction (the x-axis), and may have a first end attached to connector 422, and a second free end extending away from connector 422. Although signal conductors are not illustrated in FIG. 4C, the projecting members may be in an impedance affecting relationship with the signal conductors in the mating region between the connectors, when the connectors are separated. The shape and position of the projecting members may be such that the impedance of the signal conductors in this mating region provides a desired impedance, regardless of separation between the connectors.

The projecting members may be dielectric, and may be formed, in some embodiments, from dielectric material of the type forming connectors 421 and 422. Regions 435 and 437 are adjacent projecting member 426 and will be referred to herein as "openings". Likewise, region 436 located between projecting member 425 and 436 will also be referred to herein as an "opening". When the connectors are fully mated, projecting member 426 may fill opening 436 and projecting members 425 and 427 may fill opening 435 and 437 respectively. As a result, the signal conductors may exhibit an impedance profile that is uniform along the mating direction. When partially mated, as illustrated in FIG. 4C, the dielectric projecting member may not extend all the way into the openings, occupying less of the impedance affecting position, and leaving a region with a void. However, in contrast to FIG. 4A, there is no portion along the length of the signal conductor in which there is no adjacent dielectric material, such that the change of impedance is less than in the embodiment of FIG. 4A.

Figure 4D:
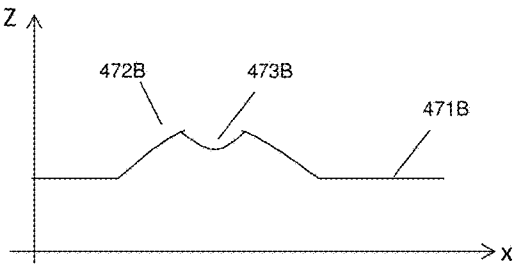
FIG. 4D is a plot showing impedance as a function of distance through the mating region of the electrical interconnection system of FIG. 4C, in accordance with some embodiments.

FIG. 4D is a plot illustrating impedance (Z) along the signal path (x-axis) in the mating region of electrical interconnection system 420. In the region corresponding to the intermediate portion of connector 421 (i.e. to region to which the projecting member(s) are attached), the impedance Z along the x-axis may be equal to a value represented in FIG. 4D as value 471B. In the regions corresponding to the projecting members, the impedance may exhibit a peak 472B due to the fact that the voids may fill with air, thus lowering the effective dielectric constant. Nevertheless, the effective dielectric constant of this region may be larger than the effective dielectric constant of region 403 illustrated in FIG. 4A as air may be replaced, at least in part, by dielectric material. The impedance may exhibit a dip 473B in correspondence with the region where projecting member 426 partially overlaps with projecting members 425 and 427. In some embodiments, dip 473B may exhibit a minimum having a value equal to 771B. However, the application is not limited in this respect.

Compared to the electrical interconnection system 400, the projecting members of electrical interconnection system 420, even if they do not extend fully into the connector as a result of separation between the connectors, fill with a dielectric member at least a portion of the opening, thereby replacing air that might otherwise exist in that separation. Because this dielectric constant is closer to what would be experienced in the fully mated position, the magnitude of the change in impedance as a result of separation is less than had the entire space been filled with air as illustrated in FIG. 4A.

In some embodiments, the impact of the separation between the connectors may be spread over a longer distance. By distributing changes in impedance over a greater distance along the signal path, the abruptness of the change in impedance at any given location may be less, and the impact of that change may likewise be less.

Figure 4E:
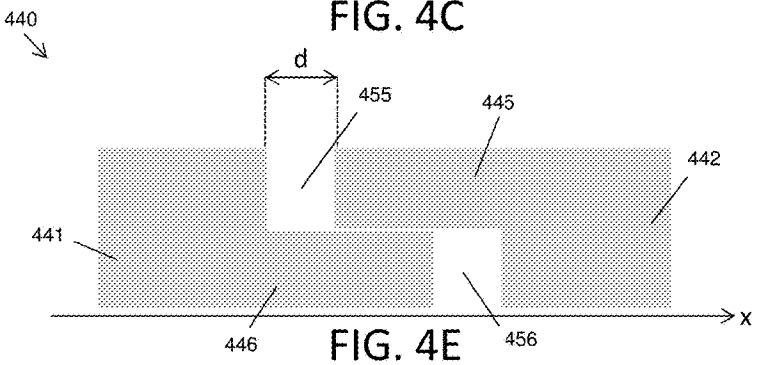
FIG. 4E is a schematic illustration of the mating region of another electrical interconnection system having at least one projection, in accordance with some embodiments.

FIG. 4E is a schematic illustration of an electrical interconnection system 440 comprising a plurality of projecting members, in accordance with some alternative embodiments. Electrical interconnection system 440 may comprise connector 441 and connector 442. The connectors may be separated by a distance d less than the functional mating region of electrical interconnection system 440. Connector 441 may comprise projecting member 446, which may extend along the mating direction (the x-axis), and may have a first end attached to connector 441, and a second free end extending away from connector 441. Connector 442 may comprise projecting members 445, which may extend along the mating direction (the x-axis), and may have a first end attached to connector 442, and a second free end extending away from connector 442. Although signal conductors are not illustrated in FIG. 4E, the projecting members may be in an impedance affecting relationship with the signal conductors in the mating region between the connectors, when the connectors are separated. Openings 455 and 456 may be defined as the regions adjacent projecting members 446 and 445 respectively.

Figure 4F:
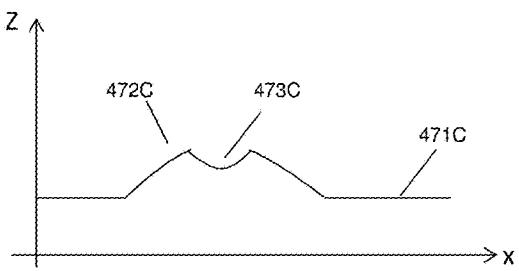
FIG. 4F is a plot showing impedance as a function of distance through the mating region of the electrical interconnection system of FIG. 4E, in accordance with some embodiments.

The discussion of the projecting members provided in connection with electrical interconnection system 420 may apply to electrical interconnection system 440 as well. FIG. 4F is a plot illustrating impedance (Z) along the signal path (x-axis) in the mating region of electrical interconnection system 440. In the region corresponding to the intermediate portion of connector 441 (i.e. to region to which the projecting member(s) are attached), the impedance Z along the x-axis may be uniform and equal to a value represented in FIG. 4F as value 471C. In the regions corresponding to the projecting members, the impedance may exhibit a peak 472C due to the fact that the voids may fill with air, thus lower the effective dielectric constant. Nevertheless, the effective dielectric constant of this region may be larger than the effective dielectric constant of region 403 illustrated in FIG. 4A as air may be replaced, at least in part, by dielectric material. The impedance may exhibit a dip 473C in correspondence with the region where projecting member 446 partially overlaps with projecting member 445. In some embodiments, dip 473C may exhibit a minimum having a value equal to 771C. However, the application is not limited in this respect. Compared to electrical interconnection system 420, the presence of the projecting members in the mating region may decrease the change in impedance experienced along the mating direction. In some embodiments, the impact of the separation between the connectors may be spread over a longer distance.

Figure 5A:
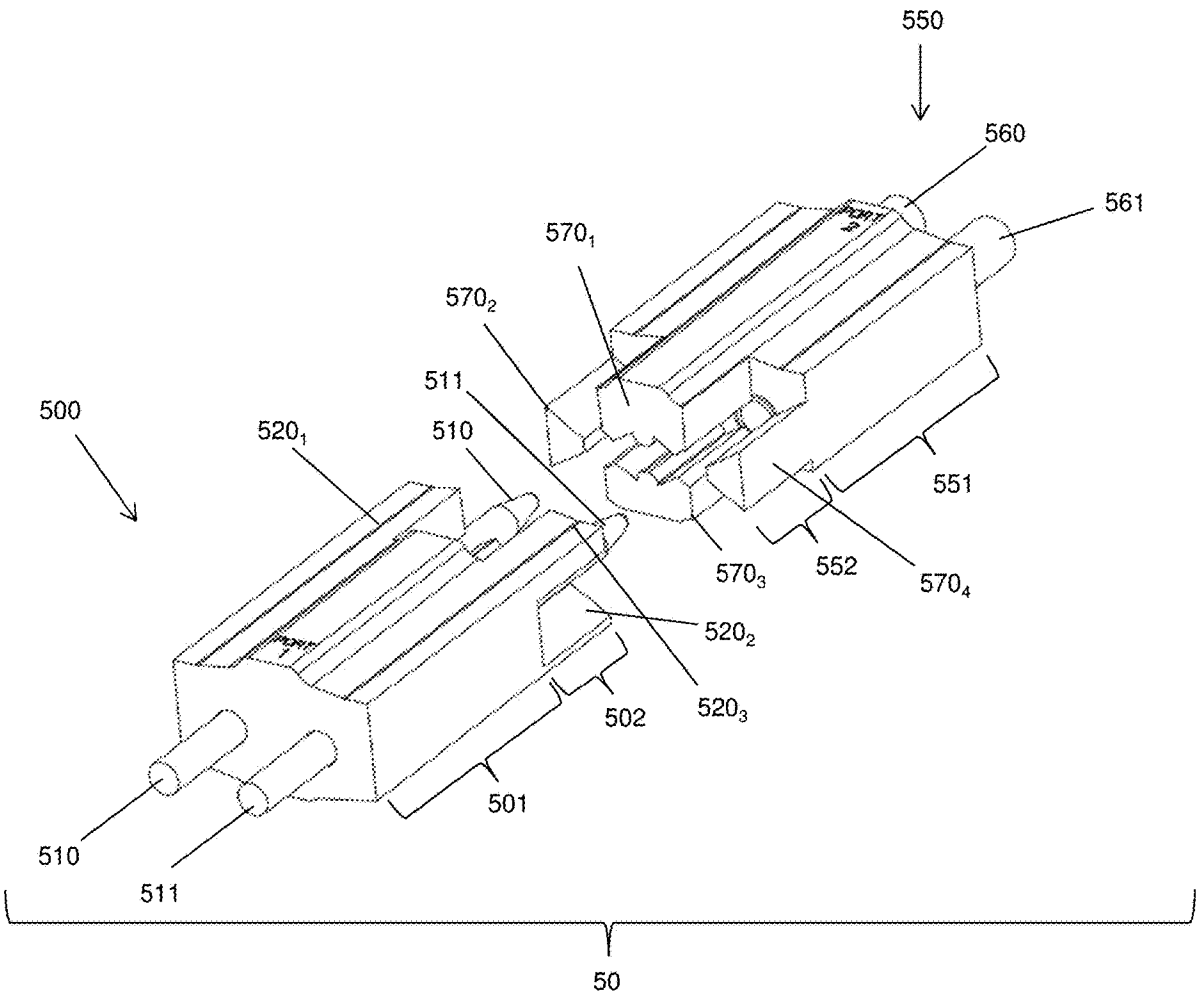
FIG. 5A is an isometric view of an exemplary electrical interconnection system comprising a plurality of projections, shown in an demated position, in accordance with some embodiments.

FIG. 5A illustrates an electrical interconnection system 50 comprising at least one mating contact portion and a plurality of projecting members, in accordance with some embodiments. Electrical interconnection system 50 may be one of multiple sets of mating modules in a connector, and may serve as an example of interconnection system 420 of FIG. 4C. In FIG. 5A electrical interconnection system 50 is shown in a demated position. Electrical interconnection system 50 may comprise connector 500 and connector 550, each of which may serve as module 161A, 161B, 161C or 161D of FIG. 1C, or alternatively, as module 213 or 224 of FIG. 2. Connector 500 may comprise an intermediate portion 501 and a mating region 502 comprising a plurality of projecting members $\mathbf{520}_1$, $\mathbf{520}_2$, $\mathbf{520}_3$, $\mathbf{520}_4$ and $\mathbf{520}_5$ ($\mathbf{520}_4$ and $\mathbf{520}_5$ not visible in FIG. 5A), attached to the intermediate portion. Each projecting member may have a first end attached to intermediate portion 501, and a second free end extending away from intermediate portion 501. The projecting members may be elongated in the mating direction.

In some embodiments, intermediate portion 501 may be part of, or connected to a connector or module housing, such as the housing illustrated in FIG. 1B and FIG. 2. In some embodiments the projecting members may be made of the same material as intermediate portion 501. In some embodiments, intermediate portion 501 may be made of plastic or nylon. Example of such materials are liquid crystal polymer (LCP), polyphenyline sulfide (PPS) and high temperature nylon or polypropylene (PPO). However, the application is not limited in this respect and any other suitable material having a dielectric constant greater the one may be used. Connector 500 may comprise one or more mating contact portions, such as mating contact portions 510 and 511. The mating contact portions may be made of any suitable electrically conducting material and may extend along a mating direction. In some embodiments, the mating contact portions may extend in parallel to the projecting members. The mating contact portion may be configured to extend beyond the free end of the projecting members along the mating direction. In some embodiments, mating contact portions 510 and 511 may be configured to operate as a differential pair. In other embodiments, connector 500 may comprise a single, single-ended mating contact portions, or any suitable number of single ended or differential pairs. In some embodiments, each mating contact portion may have a tapered end such that the width of the conductor is reduced toward the end of the conductor. Tapered ends may reduce the force needed to mate connector 500 with connector 550 and/or may facilitate guiding the mating contact portions 510 and 511 into the receptacles of connector 550.

Connector 550 may comprise dielectric material configured to provide an intermediate portion 551 and a mating region 552 comprising a plurality of projecting members $\mathbf{570}_1$, $\mathbf{570}_2$, $\mathbf{570}_3$ and $\mathbf{570}_4$, attached to the intermediate portion. Each projecting member may have a first end attached to intermediate portion 551, and a second free end extending away from intermediate portion 551. The projecting members may be elongated in the mating direction. In some embodiments, intermediate portion 551 may be part of, or connected to a housing, such as the housing illustrated in FIG. 1A and FIG. 2. In some embodiments the projecting members may be made of the same material as intermediate portion 551. In some embodiments, intermediate portion 551 may be made of plastic or nylon. Examples of such materials are liquid crystal polymer (LCP), polyphenyline sulfide (PPS) and high temperature nylon or polypropylene (PPO). However, the application is not limited in this respect and any other suitable material having a dielectric constant greater the one may be used.

Connector 550 may comprise one or more mating contact portions, such as mating contact portions 560 and 561. The mating contact portions may be made of any suitable electrically conducting material and may extend along a mating direction. In some embodiments, the mating contact portions may extend in parallel to the projecting members. Mating contact portions 560 and 561 may comprise receptacles configured to receive mating contact portions 510 and 511 when connector 500 and 550 are mated.

Figure 5B:
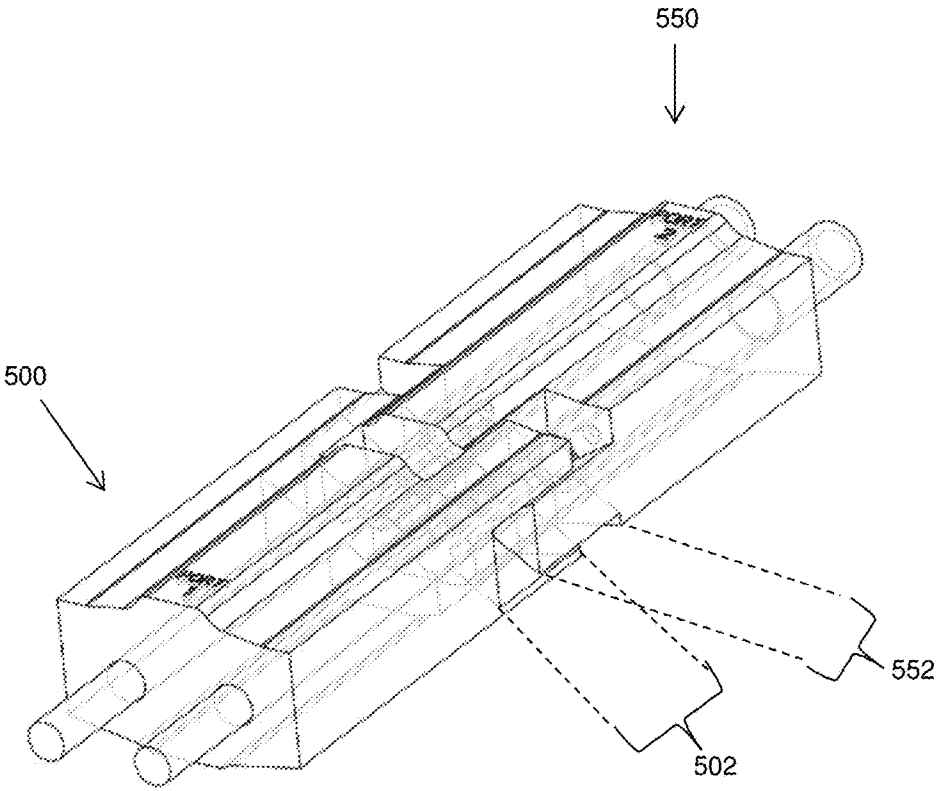
FIG. 5B is an isometric view of the exemplary electrical interconnection system of FIG. 5A, shown in a partially mated position, in accordance with some embodiments.

FIG. 5B illustrates the electrical interconnection system 50 in a partially mated position. Electrical interconnection system 50 may be in a partially mated position when each of the mating contact portions of connector 500 forms an electrical connection with a respective mating contact portions of connector 550, such that the projecting members of a connector are not in contact with the intermediate portion of the other connector. In a partially mated position, mating region 502 partially overlaps with mating region 552. As illustrated in FIG. 5B, the projecting members of connector 500 may occupy, in part, the opening formed between adjacent projecting members of connector 550. As discussed in connection with FIG. 4C, the presence of the projecting members may increase the effective dielectric constant of the mating regions 502 and 552 compared to the dielectric constant of region 403 illustrated in FIG. 4A as air may be replaced, at least in part, by dielectric material. Consequently, the magnitude of the change in impedance as a result of separation is less than had the entire space been filled with air as illustrated in FIG. 4A.

Figure 5C:
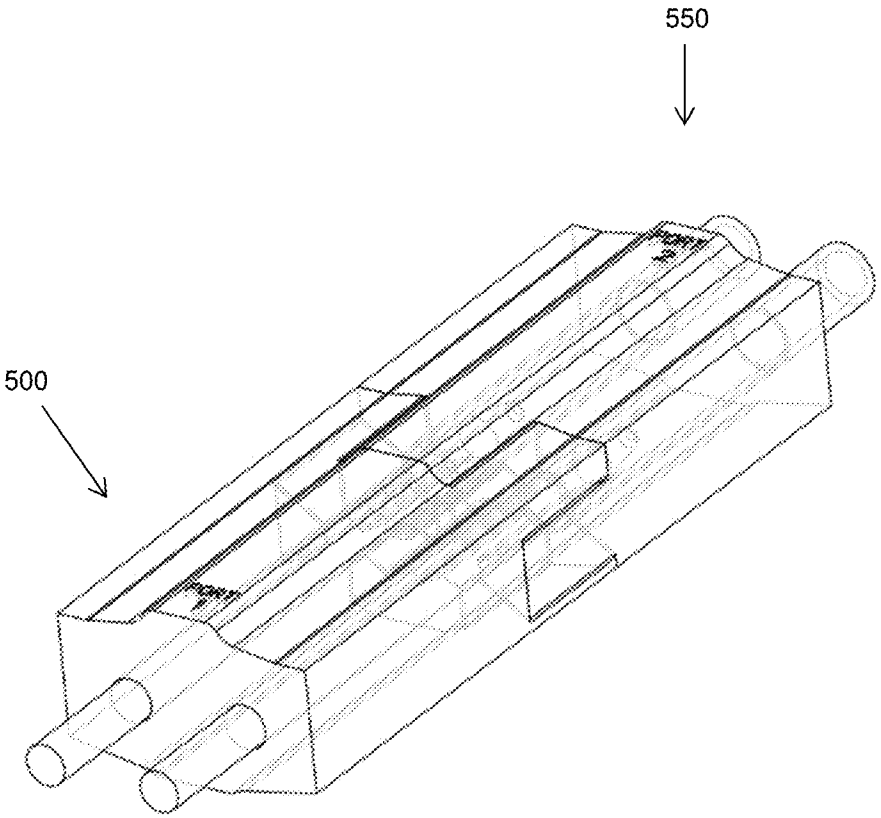
FIG. 5C is an isometric view of the exemplary electrical interconnection system of FIG. 5A, shown in a fully mated position, in accordance with some embodiments.

FIG. 5C illustrates the electrical interconnection system 50 in a fully mated position. Electrical interconnection system 50 may be in a fully mated position when each of the mating contact portions of connector 500 forms an electrical connection with a respective mating contact portions of connector 550, and at least one projecting member of a connector is in contact with the intermediate portion of the other connector. In a fully mated position, mating regions 502 completely overlaps with mating region 552 if the lengths of the projecting members of connector 550 are equal to the lengths of the projecting members of connector 500. In some embodiments, the projecting members of one connector may fully occupy the openings formed between the adjacent projecting members of the other connector.

In the fully mated position, the electrical interconnection system may exhibit an impedance profile along the mating direction that is substantially uniform. For example, the impedance profile may exhibit a variation along the mating direction that is less than 5 Ohms in some embodiments, less than 3 Ohms in some embodiments, less than 1 Ohm in some embodiments, or less than any other suitable value. In some embodiments, electrical interconnection system 50 may be designed to exhibit, in a fully mated position, an impedance that is less than the desired connector impedance by a few Ohms (e.g. 5 Ohms or less). However, if the interconnection system is operated, as often is the case, in a partially mated position, the impedance may slightly increase, thus reducing the gap between the designed impedance and the desired impedance. By way of example and not limitation, a 100 Ohms interconnection system may be designed to exhibit a 96 Ohms impedance in the fully mated position. However, in some circumstances, the interconnection system may be operated in a partially mated position and may exhibit a maximum impedance that is between 98 Ohms and 102 Ohms.

Figure 6B:
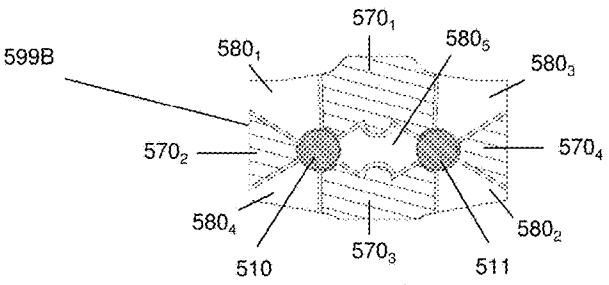
FIGS. 6B-6D are cross sectional views of the exemplary electrical interconnection system of FIG. 5A, in accordance with some embodiments.
Figure 6C:
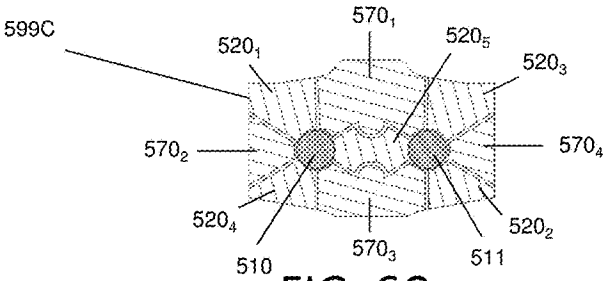
Figure 6D:
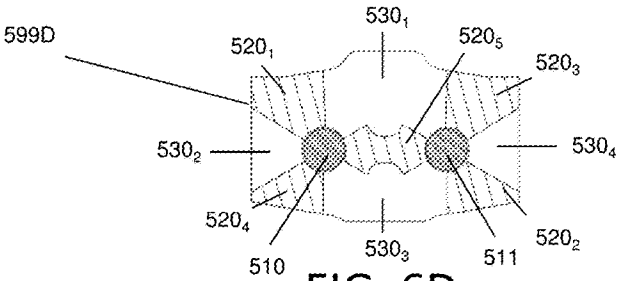
Figure 6A:
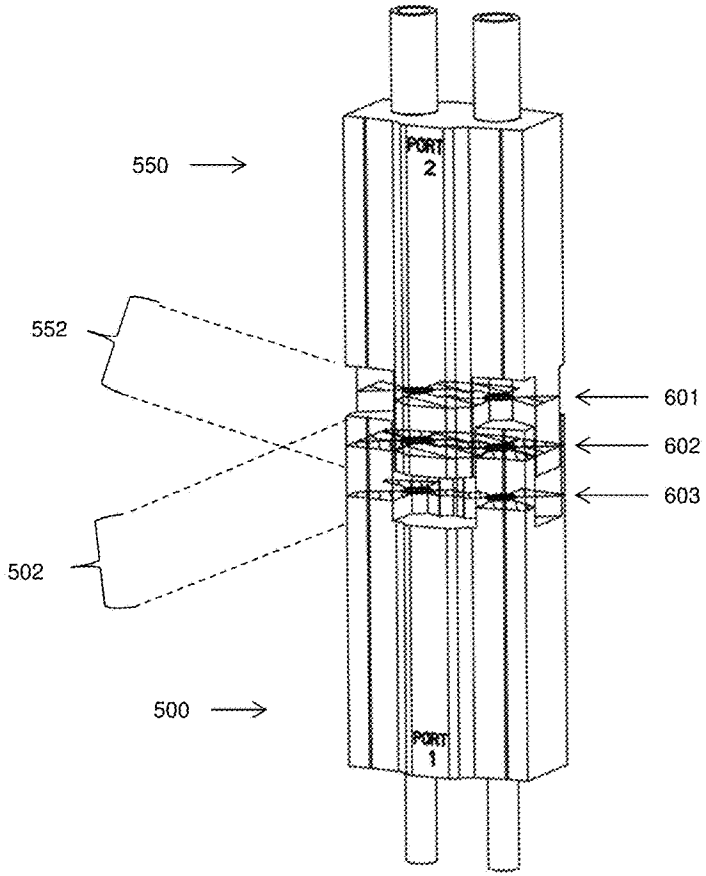
FIG. 6A is an isometric view of the exemplary electrical interconnection system of FIG. 5A illustrating three cross sections.

FIG. 6A is an isometric view of electrical interconnection system 50 shown in a partially mated position. FIG. 6A illustrates cross sections 601, 602 and 603 of the electrical interconnection system. Cross section 601 is taken within mating region 552 but outside mating region 502. Cross section 602 is taken within mating regions 552 and 502. Cross section 603 is taken within mating region 502 but outside mating region 552. FIG. 6B, FIG. 6C and FIG. 6D illustrate cross sections 601, 602 and 603 respectively, in accordance with some embodiments. At cross section 601, electrical interconnection system 50 may comprise mating contact portions 510 and 511 of connector 500 and projecting members $\mathbf{570}_1$, $\mathbf{570}_2$, $\mathbf{570}_3$ and $\mathbf{570}_4$ of connector 550. FIG. 6B further illustrates opening $\mathbf{580}_1$, formed between projecting members $\mathbf{570}_1$ and $\mathbf{570}_2$, opening $\mathbf{580}_2$, formed between projecting members $\mathbf{570}_3$ and $\mathbf{570}_4$, opening $\mathbf{580}_3$, formed between projecting members $\mathbf{570}_1$ and $\mathbf{570}_4$, opening $\mathbf{580}_4$, formed between projecting members $\mathbf{570}_3$ and $\mathbf{570}_2$ and opening $\mathbf{580}_5$, formed between projecting members $\mathbf{570}_1$, $\mathbf{570}_3$, $\mathbf{570}_3$ and $\mathbf{570}_4$.

The cross section illustrated in FIG. 6B is enclosed by an imaginary perimeter 599B. Though, it should be appreciated that, in some embodiments, shielding or other structures may be present to delimit a perimeter. The volume enclosed within mating region 522, and within perimeter 599B, may be defined herein as the volume of mating region 522. The volume of mating region 522 may be equal to the sum of the volume occupied by the projection members and the volume of the openings (which may include the volume occupied by the mating contact portions within mating region 522). In some embodiments, the volumes may be equal within some suitable tolerance, such that the volume occupied by the projection members may be within 5% of the volume of the openings within mating region 522, within 10%, within 20% or within any other suitable tolerance.

At cross section 603, electrical interconnection system 50 may comprise mating contact portions 510 and 511 of connector 500 and projecting members $\mathbf{520}_1$, $\mathbf{520}_2$, $\mathbf{520}_3$, $\mathbf{520}_4$ and $\mathbf{570}_5$ of connector 500. FIG. 6D further illustrates opening $\mathbf{530}_1$, formed between projecting members $\mathbf{520}_1$, $\mathbf{520}_5$ and $\mathbf{570}_3$, opening $\mathbf{530}_2$, formed between projecting members $\mathbf{520}_1$ and $\mathbf{520}_4$, opening $\mathbf{530}_3$, formed between projecting members $\mathbf{520}_4$, $\mathbf{520}_5$ and $\mathbf{570}_2$ and opening $\mathbf{530}_4$, formed between projecting members $\mathbf{520}_3$ and $\mathbf{520}_2$. In some embodiments, projection member $\mathbf{520}_5$ may be disposed between mating contact portions 500 and 511.

The cross section illustrated in FIG. 6D is enclosed by an imaginary perimeter 599D. The volume enclosed within mating region 502, within perimeter 599D, may be defined herein as the volume of mating region 502. The volume of mating region 502 may be equal to the sum of the volume occupied by the projection members and the volume of the openings (which may include the volume occupied by the mating contact portions within mating region 502). In some embodiments, the volume occupied by the projection members may be within 20% of the volume of the openings within mating region 502, within 30%, within 40% or within any other suitable range.

At cross section 602, electrical interconnection system 50 may comprise mating contact portions 510 and 511 of connector 500, projecting members $\mathbf{570}_1$, $\mathbf{570}_2$, $\mathbf{570}_3$ and $\mathbf{570}_4$ of connector 550 and projecting members $\mathbf{520}_1$, $\mathbf{520}_2$, $\mathbf{520}_3$, $\mathbf{520}_4$ and $\mathbf{520}_5$. In some embodiments, projection member $\mathbf{520}_1$, $\mathbf{520}_2$, $\mathbf{520}_3$, $\mathbf{520}_4$ and $\mathbf{520}_5$ of connector 500 may occupy, at least in part, the volumes corresponding to opening $\mathbf{580}_1$, $\mathbf{580}_2$, $\mathbf{580}_3$, $\mathbf{580}_4$ and $\mathbf{580}_5$ respectively, in the region where mating region 502 overlaps with mating region 522. In some embodiments, projection member $\mathbf{530}_1$, $\mathbf{530}_2$, $\mathbf{530}_3$ and $\mathbf{530}_4$ may occupy, at least in part, the volumes corresponding to opening $\mathbf{570}_1$, $\mathbf{570}_2$, $\mathbf{570}_3$ and $\mathbf{570}_4$ respectively, in the region where mating region 502 overlaps with mating region 522.

Figure 7B:
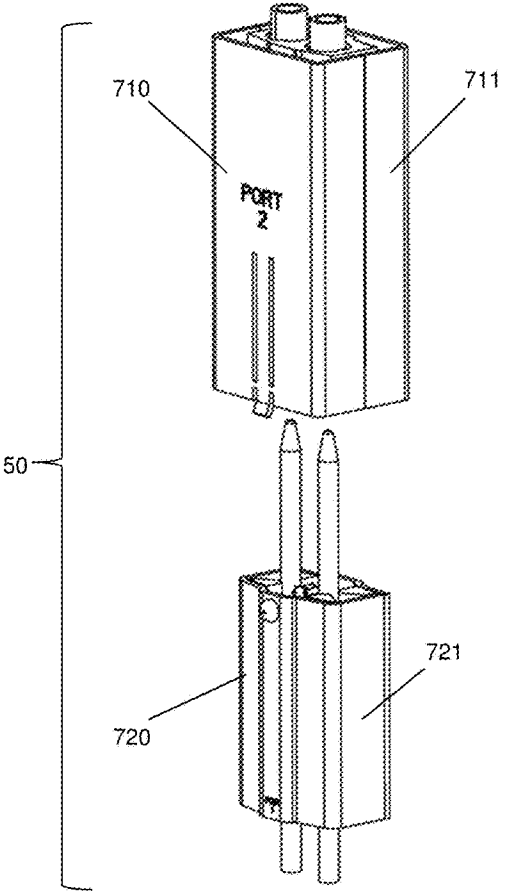
FIG. 7B is an isometric view of the exemplary electrical interconnection system of FIG. 5A illustrating a shield, in accordance with some embodiments.
Figure 7A:
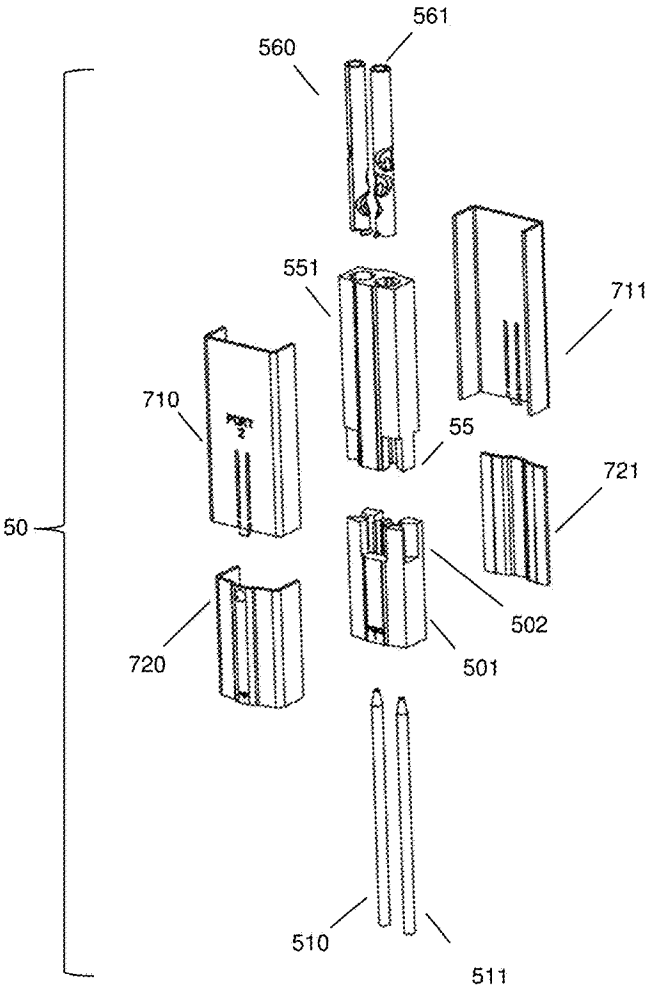
FIG. 7A is an exploded view of an exemplary electrical interconnection system, in accordance with some embodiments.

FIG. 7A is an exploded view of the electrical interconnection system 50, in accordance with some embodiments. Electrical interconnection 50 may comprise an insulative housing with an intermediate portion 501, having one or more projecting members attached thereon, mating contact portions 510 and 511, intermediate portion 551, having one or more projecting members attached thereon, and mating contact portions 560 and 561, which may comprise receptacles in some embodiments. According to one aspect of the present application, electrical interconnection system 50 may comprise a shield. The shield may be configured to enclose, at least in part, connector 500 and 500. For example, FIG. 7A illustrates shield portions 720 and 721 configured to enclose, at least in part, connector 500 and shield portions 710 and 711 configured to enclose, at least in part, connector 550. In some embodiments, the shield portions may comprise one or more conducting materials. In some embodiments, the shield portions may be configured to be used as a reference conductor for the mating contact portion(s).

FIG. 7B is an isometric view of the electrical interconnection system 50 comprising a shield, in accordance with some embodiments. In the non-limiting embodiment of FIG. 7B, shield portions 720 and 721 enclose connector 500 such that the projecting members are enclosed and shield portions 710 and 711 enclose connector 550 such that the projecting members are enclosed.

Figure 8C:
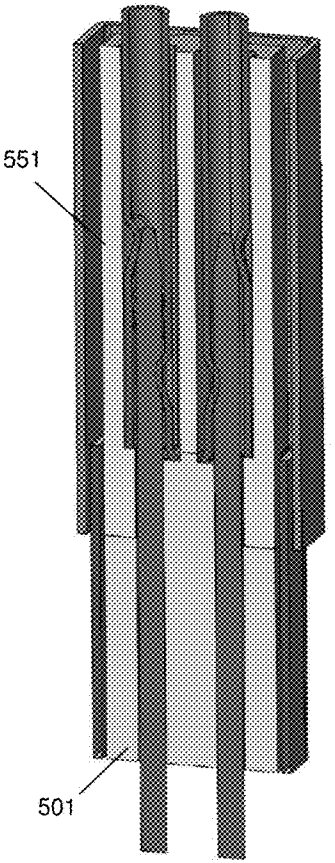
FIGS. 8A-8C are isometric views of three exemplary steps of a mating sequence, in accordance with some embodiments.
Figure 8B:
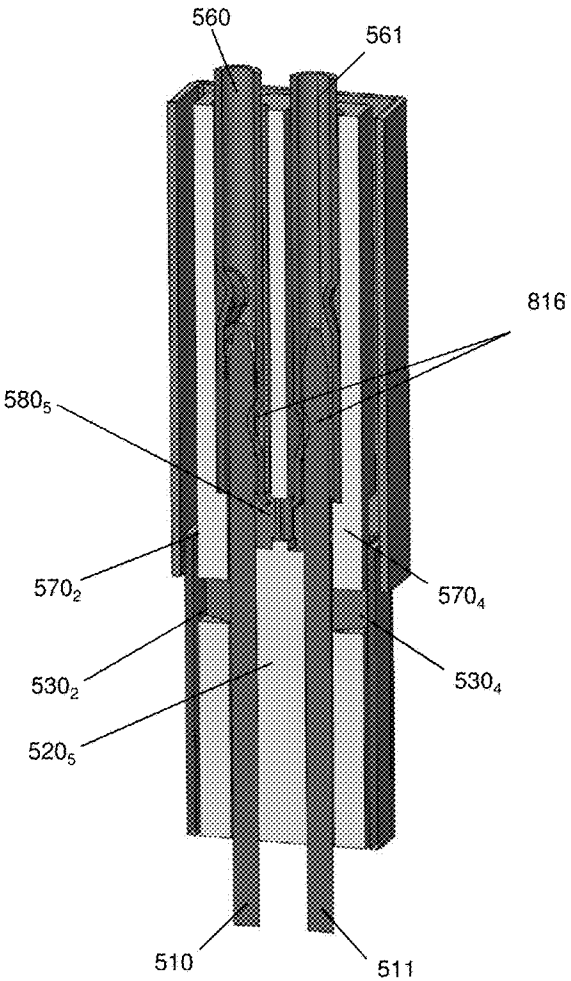
Figure 8A:
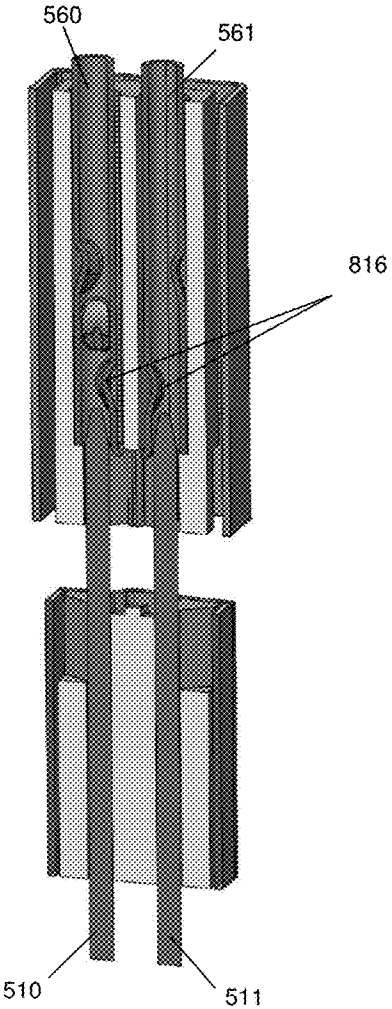

A mating sequence may begin by positioning connector 500 in proximity to electrical connector 550, such that the projecting members of connector 500 overlap, at least in part, with the projecting members of connector 550 with respect to a plane that is perpendicular to the mating direction. FIGS. 8A-8C illustrate three exemplary steps of a mating sequence, in accordance with some embodiments. As illustrated in FIG. 8A, once the connector are positioned in proximity to one another, the mating sequence may progress by sliding, along the mating direction, connector 500 toward connector 550, and/or vice versa. The connectors may create electrical contacts when at least one mating contact portion of connector 500 is in contact with a mating contact portion of connector 550. In some embodiments, mating contact portions 560 and 561 may comprise one or more bumps, such as bumps 816, extending inward. The bumps may be configured to hold mating contact portions 510 and 511 in position, by providing friction, once the connectors are mated. The mating sequence may continue to the example illustrates in FIG. 8B, in which the projection members of connector 500 are engaged, at least in part, with respective openings of connector 550, and vice versa. For example, projection member $\mathbf{570}_2$, $\mathbf{520}_5$ and $\mathbf{570}_4$ may engage with opening $\mathbf{530}_2$, $\mathbf{580}_5$ and $\mathbf{530}_4$ respectively. As the sequence continues, the projecting member may progressively occupy a larger portion of the openings. In some embodiments, mating contact portions 510 and 511 may be in contact with bumps 816.

The sequence may continue to the example illustrated in FIG. 8C, in which the connector are fully mated. However, the sequence may end at a partially mated position in some embodiments. In the example illustrated in FIG. 8C, at least one projecting member of connector 500 is in contact with the intermediate portion 551 of connector 550 and/or at least one projecting member of connector 550 is in contact with the intermediate portion 501 of connector 500.

Figure 9A:
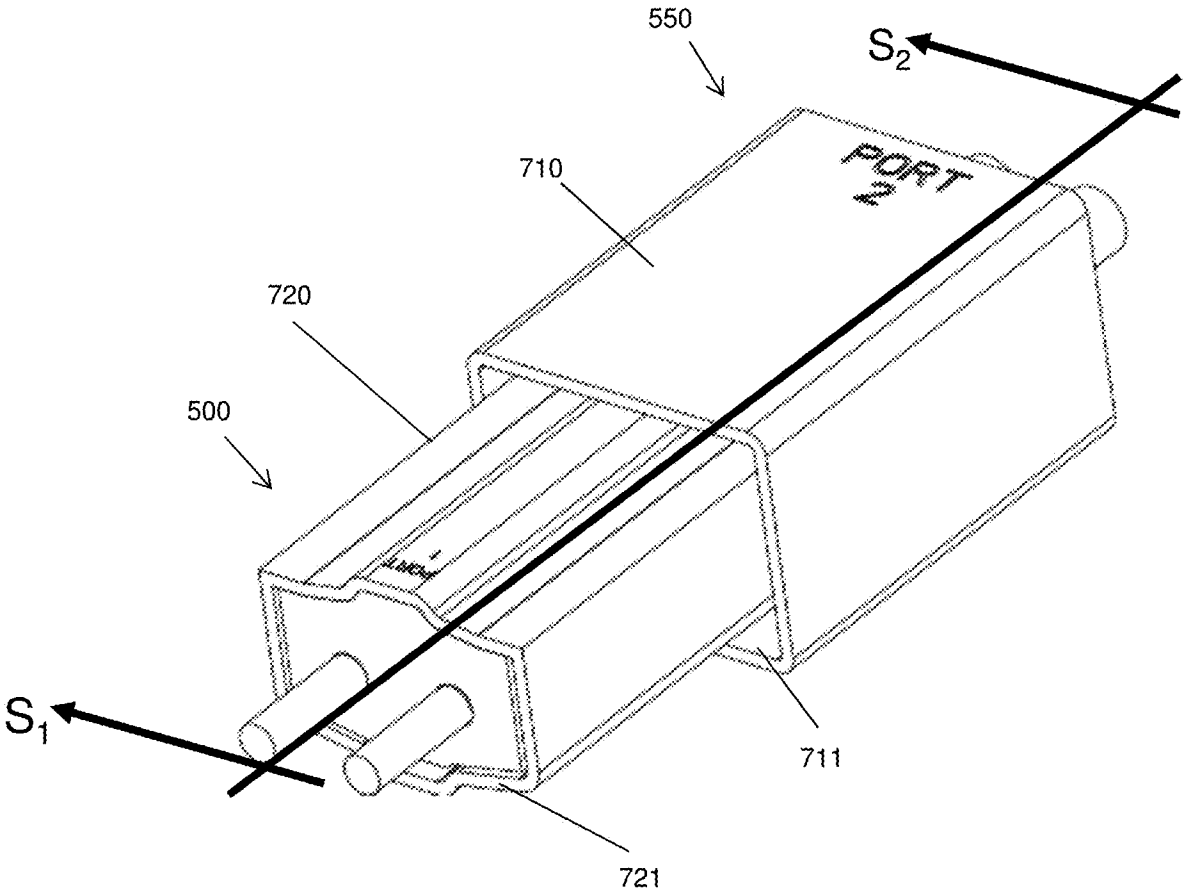
FIG. 9A is an isometric view of the exemplary electrical interconnection system of FIG. 5A shown in a fully mated position, in accordance with some embodiments.

FIG. 9A is an isometric view of the electrical interconnection system 50 shown in a fully mated position, in accordance with some embodiments. In the illustrated example, connector 500 is enclosed within a shield comprising shield portions 720 and 721, and connector 550 is enclosed within a shield comprising shield portions 710 and 711. As with the embodiment of FIG. 1, interconnection system 50 may serve as one of many pairs of mating modules held together to form a connector.

Figure 9B:
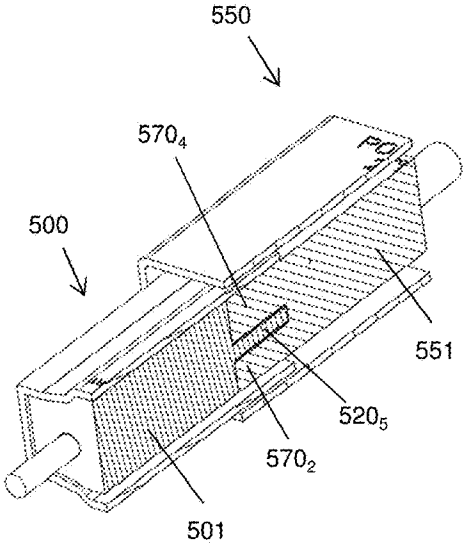
FIGS. 9B-9D are cross sections, along the line $S_1$-$S_2$ of FIG. 9A, illustrating three exemplary steps of a demating sequence, in accordance with some embodiments.
Figure 9C:
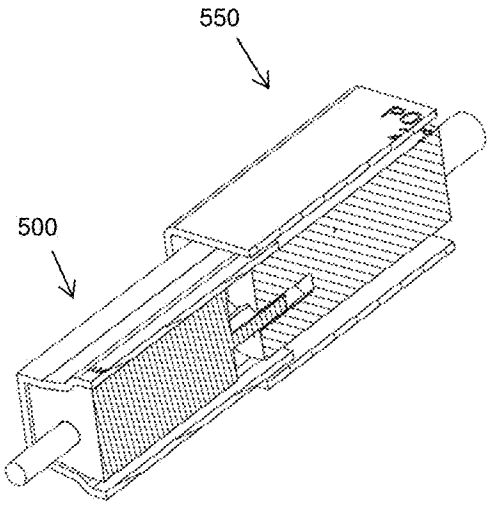
Figure 9D:
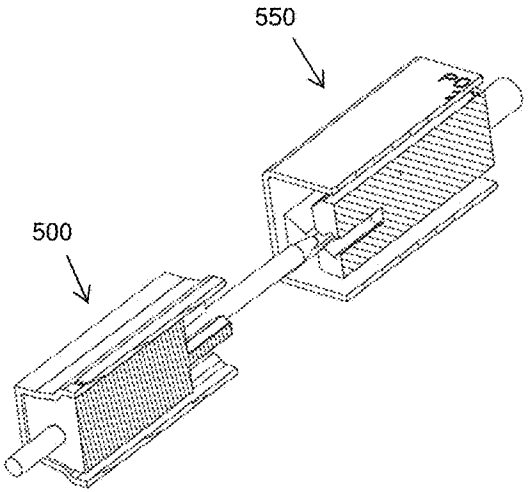

FIGS. 9B-9D illustrate three exemplary steps of a demating sequence, in accordance with some embodiments. The figures illustrate cross sectional views obtain by cutting the electrical interconnection system of FIG. 9A along the line $S_1S_2$. The demating sequence may begin at FIG. 9B, in which connector 500 is fully mated with connector 550. In the illustrated example, projection member $\mathbf{520}_5$ is in contact with intermediate portion 551 and projection members $\mathbf{570}_2$ and $\mathbf{570}_4$ are in contact with intermediate portion 501.

The demating sequence may continue to the example illustrated in FIG. 9C by sliding, along the demating direction, connector 500 away from connector 550, and/or vice versa. In the example illustrated in FIG. 9C, the projecting members are partially engaged with the respective openings, and the mating contact portions continue to form electrical contacts. In the example illustrated in FIG. 9D, the connectors are separated until the projecting members are disengaged from the respective openings, and the mating contact portions no longer form electrical contacts.

Figure 10B:
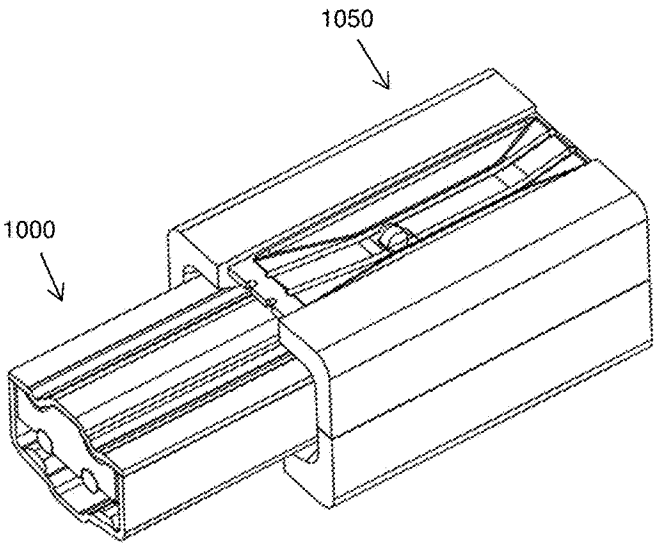
FIG. 10B is an isometric view of the exemplary electrical interconnection system of FIG. 10A, shown in a fully mated position, in accordance with some embodiments.
Figure 10A:
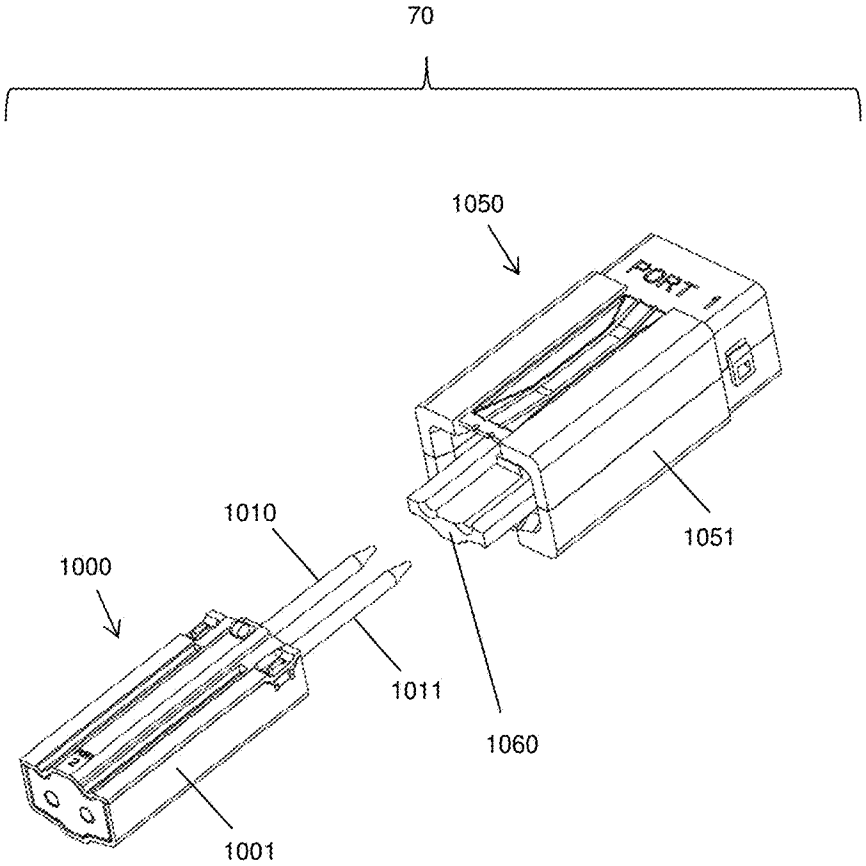
FIG. 10A is an isometric view of another exemplary electrical interconnection system, shown in a demated position, in accordance with some embodiments.

FIG. 10A illustrates an alternative embodiment of an electrical interconnection system 70 comprising at least one mating contact portion and at least one projecting member, in accordance with some embodiments. Electrical interconnection system 70 may serve as interconnection system 440 of FIG. 4E. Electrical interconnection system 70 is shown in a demated position in FIG. 10A. Electrical interconnection system 70 may comprise connector 1000 and connector 1050, each of which may serve as module 161A, 161B, 161C or 161D of FIG. 1C, or alternatively, as module 213 or 224 of FIG. 2. Connector 1000 may comprise an intermediate portion 1001. In some embodiments, intermediate portion 1001 may be part of, or connected to a housing, such as the housing illustrated in FIG. 1B and FIG. 2. Connector 1000 may comprise one or more projecting members (not visible in FIG. 10A). The projection member(s) may extend along a mating direction. Each of the projection member(s) may have a first end attached to intermediate portion 1001, and a second free end extending away from intermediate portion 1001. In some embodiments the projecting members may be made of the same material as intermediate portion 1001. In some embodiments, intermediate portion 1001 may be made of plastic or nylon, or, as with other embodiments, another similar dielectric material. Example of such materials are liquid crystal polymer (LCP), polyphenyline sulfide (PPS) and high temperature nylon or polypropylene (PPO). However, the application is not limited in this respect and any other suitable material having a dielectric constant greater the one may be used.

Connector 1000 may comprise one or more mating contact portions, such as mating contact portions 1010 and 1011. The mating contact portions may be made of any suitable electrically conducting material and may extend along a mating direction. In some embodiments, the mating contact portions may extend in parallel to the projecting members. The mating contact portion may be configured to extend beyond the free end of the projecting members along the mating direction. In some embodiments, mating contact portions 1010 and 1011 may be configured to operate as a differential pair. In other embodiments, connector 1000 may comprise a single, single-ended mating contact portions, or any suitable number of single ended or differential pairs. In some embodiments, each mating contact portion may have a tapered end such that the width of the conductor is reduced toward the end of the conductor. Tapered ends may facilitate guiding the mating contact portions 1010 and 1011 into the receptacles of connector 1050.

Connector 1050 may comprise an intermediate portion 1051. In some embodiments, intermediate portion 1051 may be part of, or connected to a housing, such as the housing illustrated in FIG. 1B and FIG. 2. Connector 1050 may comprise one or more projecting members, such as projecting member 1060. The projection member(s) may extend along a mating direction. Each of the projection member(s) may have a first end attached to intermediate portion 1051, and a second free end extending away from intermediate portion 1051. In some embodiments, the projecting member may comprise one or more grooves formed thereon. The grooves may be configured such that, when the connectors are mated, mating contact portions 1010 and 1011 can slide within respective grooves.

In some embodiments, the projecting members may be made of the same material as intermediate portion 1051. In some embodiments, intermediate portion 1051 may be made of plastic or nylon. Example of such materials are liquid crystal polymer (LCP), polyphenyline sulfide (PPS) and high temperature nylon or polypropylene (PPO). However, the application is not limited in this respect and any other suitable material having a dielectric constant greater the one may be used.

Connector 1050 may comprise one or more mating contact portions (not visible in FIG. 10A). The mating contact portions may be made of any suitable electrically conducting material and may extend along a mating direction. In some embodiments, the mating contact portions may extend in parallel to the projecting members. In some embodiments, the mating contact portions may comprise receptacles, configured to receive mating contact portions 1010 and 1011. The mating contact portion may be configured to extend beyond the free end of the projecting members along the mating direction.

FIG. 10B is an isometric view of electrical interconnection system 70 illustrated in a fully mated position. In the fully mated position, the mating contact portions of connector 1000 may form electrical contacts with the mating contact portions of connector 1050. Furthermore, in the fully mated position, the projecting member of connector 1000 may be in contact with the intermediate portion of connector 1050 and/or vice versa.

Figure 11B:
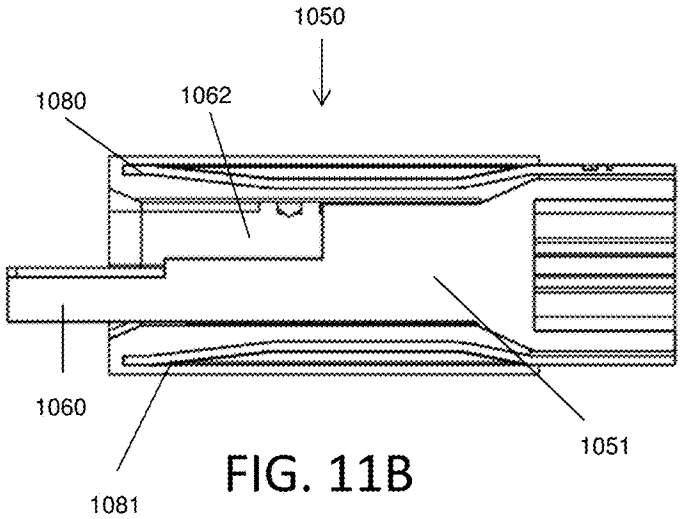
FIG. 11B is a side view of an exemplary electrical connector configured to mate with the electrical connector of FIG. 11A, in accordance with some embodiments.
Figure 11A:
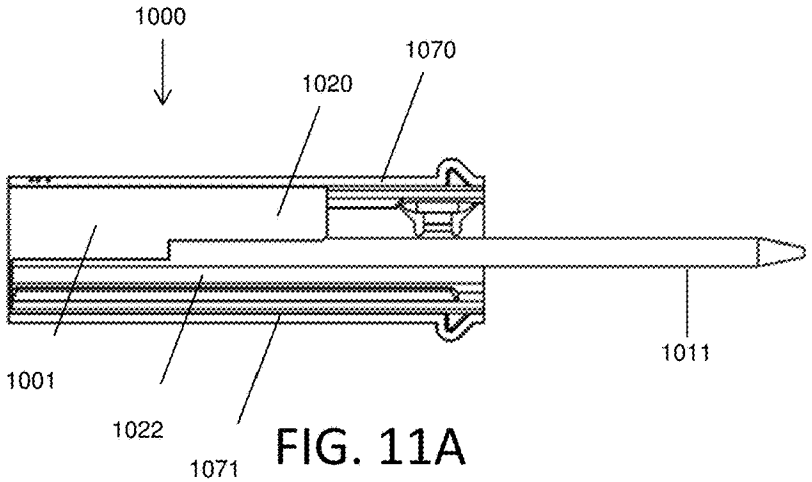
FIG. 11A is a side view of an exemplary electrical connector comprising a projection member, in accordance with some embodiments.

FIG. 11A illustrates a cross sectional view of connector 1000. In the example illustrated, connector 1000 comprises a projecting member 1020 connected to intermediate portion 1001. As illustrated, mating contact portion 1011 may extend along the mating direction beyond the free end of projecting member 1020. In some embodiments, connector 1000 may be enclosed within a shield comprising shield portions 1070 and 1071. The shield portions may comprise an electrically conducting material and/or a dielectric material. The region located between projecting member 1020 and shield portion 1071 will be referred to herein as opening 1022. Opening 1022 may be configured to receive the projection member of connector 1050 when the connectors are mated.

FIG. 11B illustrates a cross sectional view of connector 1050. In the example illustrated, connector 1050 comprises a projecting member 1060 connected to intermediate portion 1051. In some embodiments, connector 1050 may be enclosed within a shield comprising shield portions 1080 and 1081. The shield portions may comprise an electrically conducting material and/or a dielectric material. The region located between projecting member 1060 and shield portion 1080 will be referred to herein as opening 1062. Opening 1062 may be configured to receive the projection member of connector 1000 when the connectors are mated.

Figure 12A:
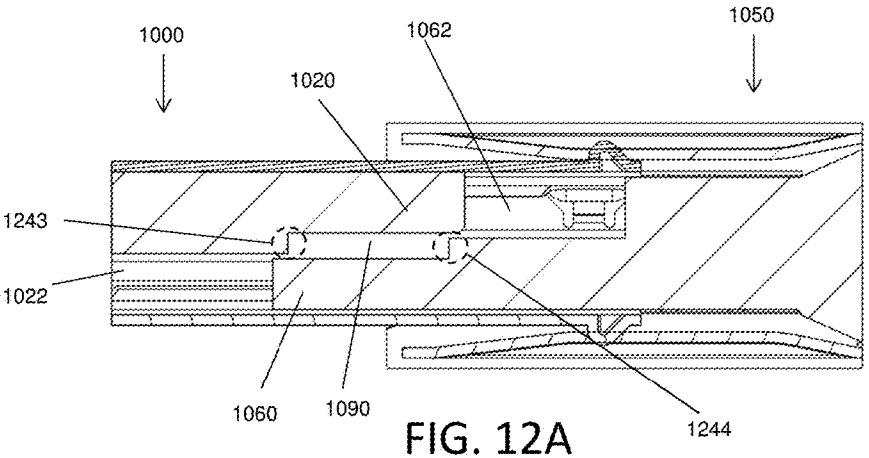
FIG. 12A is a cross sectional view of the exemplary electrical interconnection system of FIG. 10A, shown in a partially mated position, in accordance with some embodiments.

FIG. 12A illustrates a cross sectional view of electrical interconnection system 70 shown in a partially mated position, in accordance with some embodiments. In the example illustrated, projecting member 1020 is engaged, at least in part, with opening 1062, and projecting member 1060 is engaged, at least in part, with opening 1022. In some embodiments, the intermediate portion of connector 1000 may comprise a stepped profile, and may comprise one or more steps, such as step 1243. In some embodiments, the intermediate portion of connector 1050 may comprise a stepped profile, and may comprise one or more steps, such as step 1244. The region between steps 1243 and 1244, and projection members 1020 and 1060 will be referred to herein as opening 1090. Mating contact portions 1010 and 1011 may form electrical contacts with the receptacles of connector 1050.

As discussed in connection with FIG. 4E, the presence of the projecting members may increase the effective dielectric constant of the mating region compared to the dielectric constant of region 403 illustrated in FIG. 4A as air may be replaced, at least in part, by dielectric material. Consequently, the magnitude of the change in impedance as a result of separation is less than had the entire space been filled with air as illustrated in FIG. 4A.

Figure 12B:
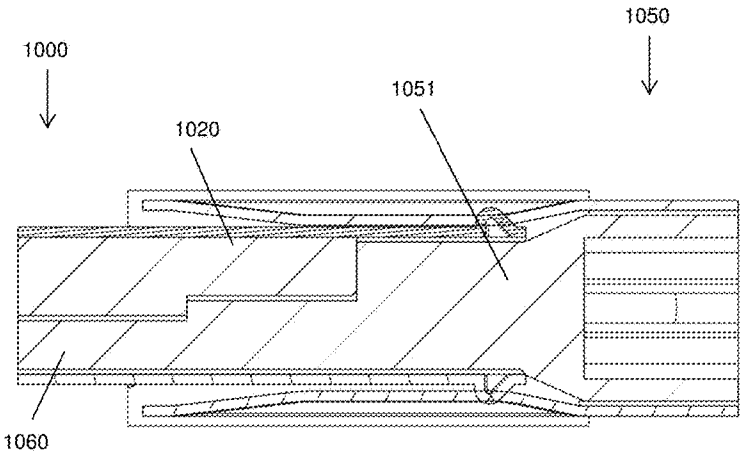
FIG. 12B is a cross sectional view of the exemplary electrical interconnection system of FIG. 10A, shown in a fully mated position, in accordance with some embodiments.

FIG. 12B illustrates a cross sectional view of electrical interconnection system 70 shown in a fully mated position, in accordance with some embodiments. In the fully mated position, projection member 1020 may be in contact with intermediate portion 1051 and/or projection member 1060 may be in contact with intermediate portion 1050 and/or step 1243 may be in contact with step 1244.

Figure 13B:
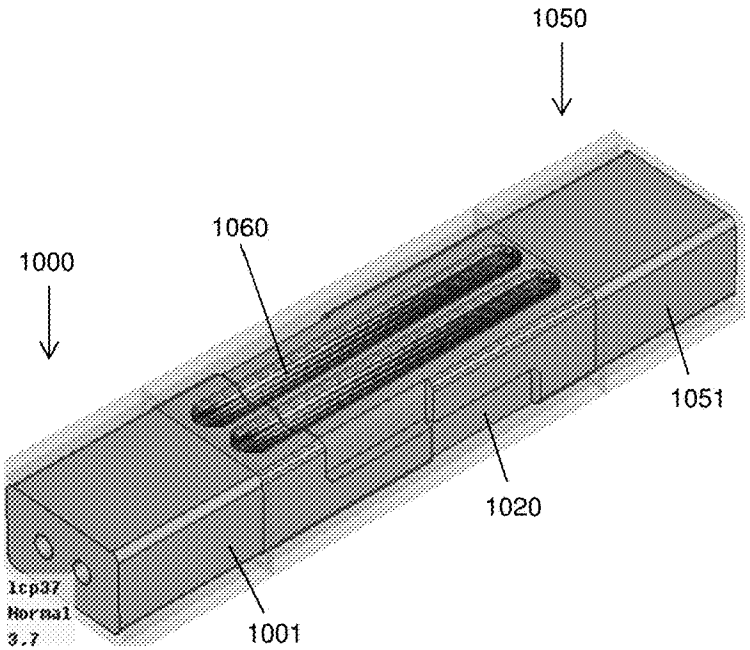
FIGS. 13A-13B illustrate two exemplary steps of a mating sequence, in accordance with some embodiments.
Figure 13A:
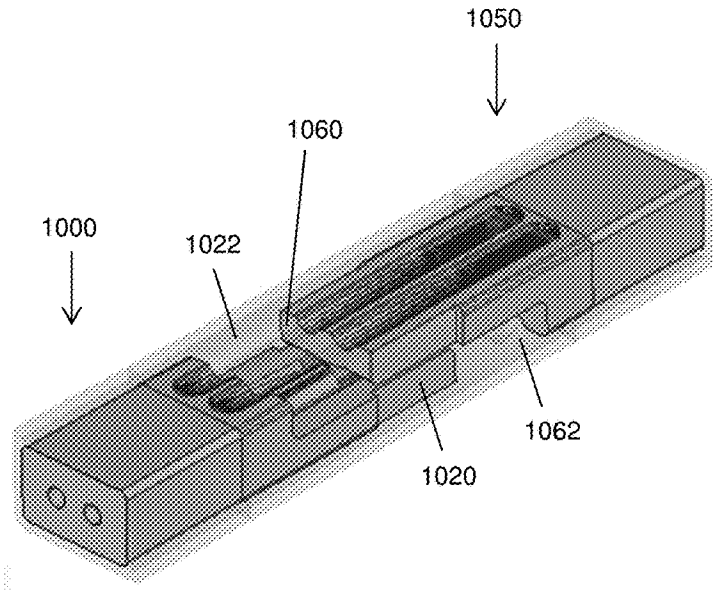

FIGS. 13A-13B illustrate two exemplary steps of a mating sequence, in accordance with some embodiments. In the example illustrated in FIG. 13A, a partially mated position is shown. The mating sequence may begin by positioning connector 1000 in proximity to connector 1050, such that projection member 1020 overlaps, at least in part, with projection member 1060 with respect to a plane perpendicular to the mating direction. Subsequently, connector 1000 may be slid toward connector 1050 and/or vice versa, such that projecting member 1020 progressively occupies a larger portion of opening 1062 and projecting member 1060 progressively occupies a larger portion of opening 1022. In the partially mated, electrical contacts may be formed between respective contact mating portions.

In the example illustrated in FIG. 13B, connector 1000 is fully mated to connector 1050. The mating sequence may continue until the fully mated position is reached. In the fully mated position, projection member 1020 may be in contact with intermediate portion 1051 and/or projection member 1060 may be in contact with intermediate portion 1050 and/or step 1243 may be in contact with step 1244.

In the fully mated position, the electrical interconnection system may exhibit an impedance profile along the mating direction that is substantially uniform. For example, the impedance profile may exhibit a variation along the mating direction that is less than 5 Ohms in some embodiments, less than 3 Ohms in some embodiments, less than 1 Ohm in some embodiments, or less than any other suitable value. In some embodiments, electrical interconnection system 70 may be designed to exhibit, in a fully mated position, an impedance that is less than the desired connector impedance by a few Ohms (e.g. 5 Ohms or less). However, if the interconnection system is operated, as often is the case, in a partially mated position, the impedance may slightly increase thus reducing the gap between the designed impedance and the desired impedance. By way of example and not limitation, a 100 Ohms interconnection system may be designed to exhibit a 96 Ohms impedance in the fully mated position. However, in some circumstances, the interconnection system may be operated in a partially mated position and may exhibit a maximum impedance that is between 98 Ohms and 102 Ohms.

Figure 14B:
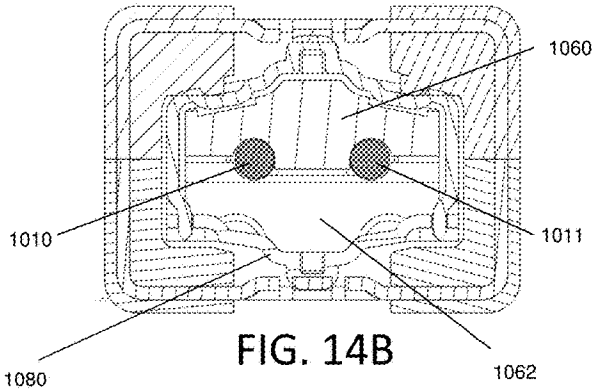
FIGS. 14B-14D are cross sectional views of the exemplary electrical interconnection system of FIG. 10A, in accordance with some embodiments.
Figure 14C:
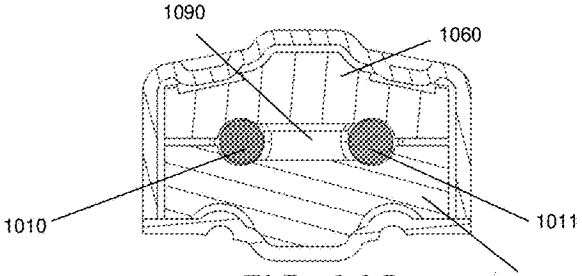
Figure 14D:
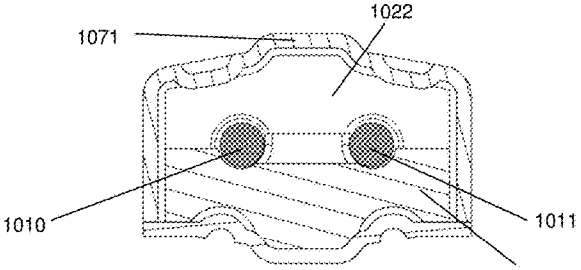
Figure 14A:
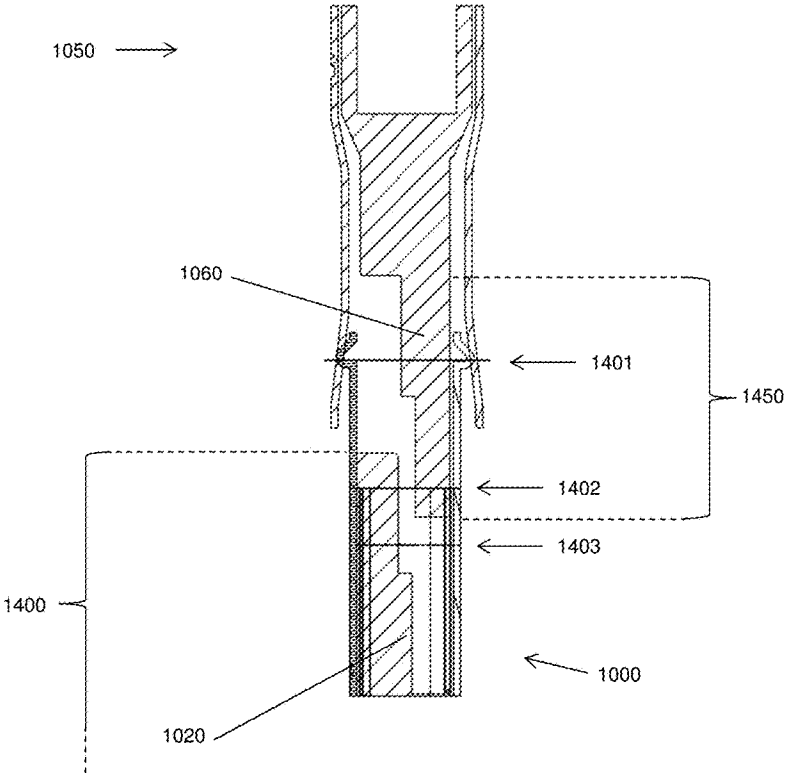
FIG. 14A is a cross sectional view of the exemplary electrical interconnection system of FIG. 10A, shown in a partially mated position.

FIG. 14A is a cross sectional view of electrical interconnection system 70 shown in a partially mated position. FIG. 14A illustrates cross sections 1401, 1402 and 1403 of the electrical interconnection system. Cross section 1401 is taken within mating region 1450 but outside mating region 1400. Cross section 1402 is taken within mating regions 1400 and 1450. Cross section 1403 is taken within mating region 1400 but outside mating region 1450. Mating region 1450 is defined as the region comprising the entire extension of projection member 1060 and mating region 1400 is defined as the region comprising the entire extension of projection member 1020. FIG. 14B, FIG. 14C and FIG. 14D illustrate cross sections 1401, 1402 and 1403 respectively, in accordance with some embodiments.

At cross section 1401, electrical interconnection system 70 may comprise mating contact portions 1010 and 1011 of connector 1000 and projecting member 1060 of connector 1050. FIG. 14B further illustrates opening 1062, formed between projecting member 1060 and shield portion 1080.

At cross section 1403, electrical interconnection system 70 may comprise mating contact portions 1010 and 1011 of connector 1000 and projecting member 1020 of connector 1000. FIG. 14D further illustrates opening 1022, formed between projecting member 1020 and shield portion 1071.

At cross section 1402, electrical interconnection system 70 may comprise mating contact portions 1010 and 1011 of connector 1000, projecting member 1020 of connector 1000 and projecting member 1060 of connector 1050. FIG. 14C further illustrates opening 1090, formed between steps 1243 and 1244 and projection members 1020 and 1060.

Figure 15A:
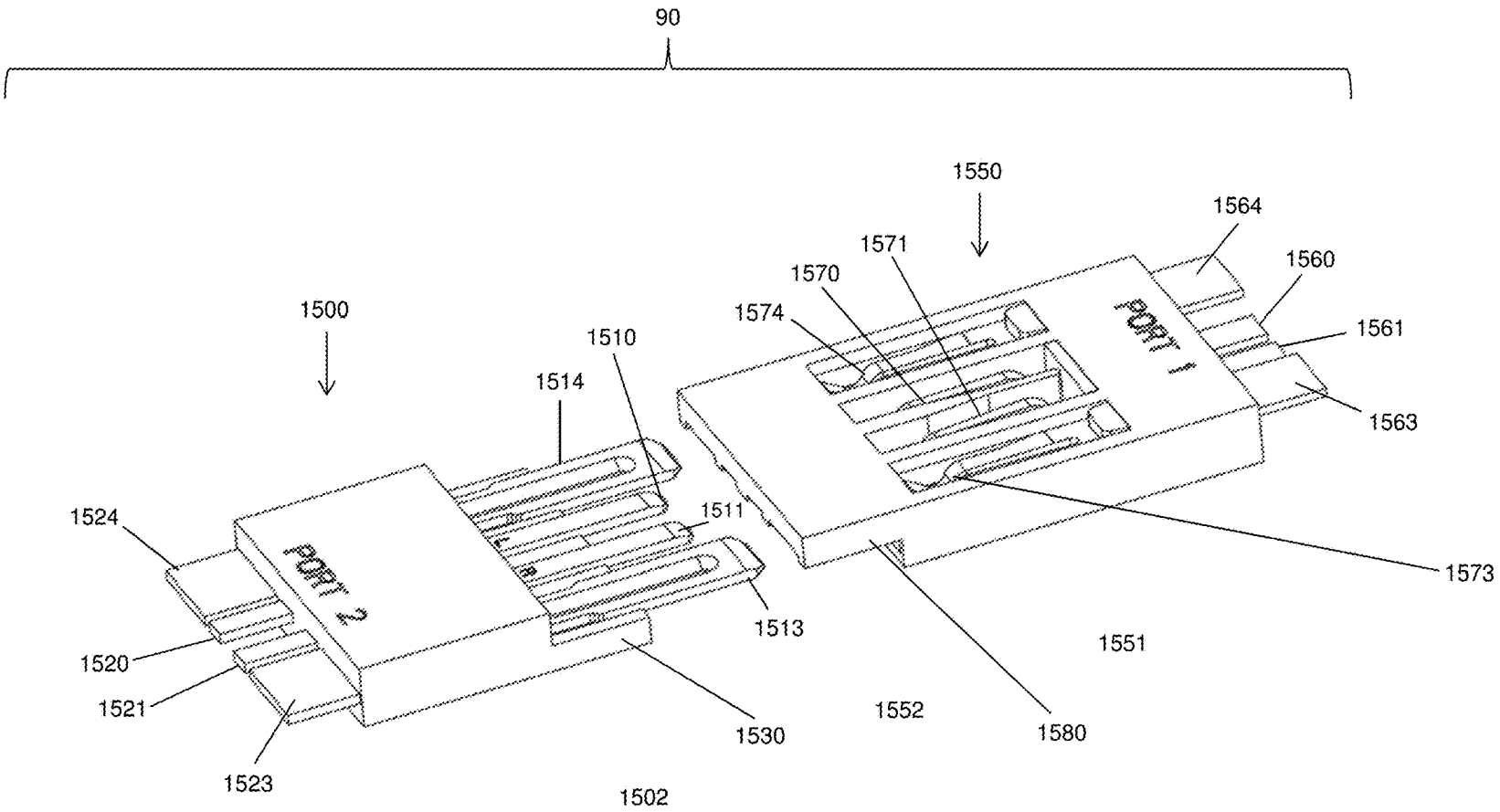
FIG. 15A is an isometric view of yet another exemplary electrical interconnection system shown in an demated position, in accordance with some embodiments.

FIG. 15A illustrates an electrical interconnection system 90 comprising at least one mating contact portion and at least one projecting member, in accordance with some embodiments. Electrical interconnection system 90 may serve as an example of an interconnection system 440 of FIG. 4E. Electrical interconnection system 90 is shown in a demated position in FIG. 15A. Electrical interconnection system 90 may comprise connector 1500 and connector 1550, each of which may serve as module 161A, 161B, 161C or 161D of FIG. 1C, or alternatively, as module 213 or 224 of FIG. 2. Connector 1500 may comprise an intermediate portion 1501 and a mating region 1502 comprising projecting members 1530, attached to the intermediate portion. The projecting member may have a first end attached to intermediate portion 1501, and a second free end extending away from intermediate portion 1501. The projecting member may be elongated in the mating direction.

In some embodiments, intermediate portion 1501 may be part of, or connected to, a housing, such as the housing illustrated in FIG. 1B and FIG. 2. In some embodiments the projecting member may be made of the same material as intermediate portion 1501. In some embodiments, intermediate portion 1501 may be made of plastic or nylon. Example of such materials are liquid crystal polymer (LCP), polyphenyline sulfide (PPS) and high temperature nylon or polypropylene (PPO). However, the application is not limited in this respect and any other suitable material having a dielectric constant greater the one may be used. Connector 1500 may comprise one or more mating contact portions, such as mating contact portions 1510, 1511, 1513 and 1514. The mating contact portions may be made of any suitable electrically conducting material and may extend along a mating direction. In some embodiments, the mating contact portions may extend in parallel to the projecting members. The mating contact portion may be configured to extend beyond the free end of the projecting members along the mating direction. In some embodiments, mating contact portions 1510 and 1511 may be configured to operate as a differential pair, and mating contact portions 1513 and 1514 may be configured to operate as reference conductors. In other embodiments, connector 1500 may comprise a single, single-ended mating contact portions, or any suitable number of single ended or differential pairs. In some embodiments, each mating contact portion may have a tapered end such that the width of the conductor is reduced toward the end of the conductor. Tapered ends may reduce the force needed to mate connector 1500 with connector 1550 and/or may facilitate guiding the mating contact portions 1510, 1511, 1513 and 1514 into the receptacles of connector 1550. Connector 1500 may further comprise contact tails 1520, 1521, 1523 and 1524, connected respectively to contact mating portions 1510, 1511, 1513 and 1514.

Connector 1550 may comprise an intermediate portion 1551 and a mating region 1552 comprising projecting member 1580, attached to the intermediate portion. The projecting member may have a first end attached to intermediate portion 1551, and a second free end extending away from intermediate portion 1551. The projecting member may be elongated in the mating direction. In some embodiments, intermediate portion 1551 may be part of, or connected to a housing, such as the housing illustrated in FIG. 1A and FIG. 2. In some embodiments the projecting members may be made of the same material as intermediate portion 1551. In some embodiments, intermediate portion 1551 may be made of plastic or nylon. Example of such materials are liquid crystal polymer (LCP), polyphenyline sulfide (PPS) and high temperature nylon or polypropylene (PPO). However, the application is not limited in this respect and any other suitable material having a dielectric constant greater the one may be used. Connector 1550 may comprise one or more mating contact portions, such as mating contact portions 1570, 1571, 1573 and 1574. The mating contact portions may be made of any suitable electrically conducting material and may extend along a mating direction. In some embodiments, the mating contact portions may extend in parallel to the projecting members. Mating contact portions 1570, 1571, 1573 and 1574 may be configured to mate with mating contact portions 1510, 1511, 1513 and 1514 respectively. In some embodiments, each contact portion of connector 1550 may comprise one or more curved portions. In some embodiments, the curved portions may extend toward a direction that is perpendicular to the mating direction. In some embodiments, when connector 1500 is slid toward connector 1550 (and/or vice versa), the mating contact portions of connector 1500 may press on the curved portions, thus causing the mating contact portions of connector 1550 to deflect. As a consequence of such deflection, the insertion resistance may reduce, and the mating contact portions of connector 1500 may move further along the mating direction. Connector 1550 may further comprise contact tails 1560, 1561, 1563 and 1564, connected respectively to contact mating portions 1570, 1571, 1573 and 1574.

Figure 15B:
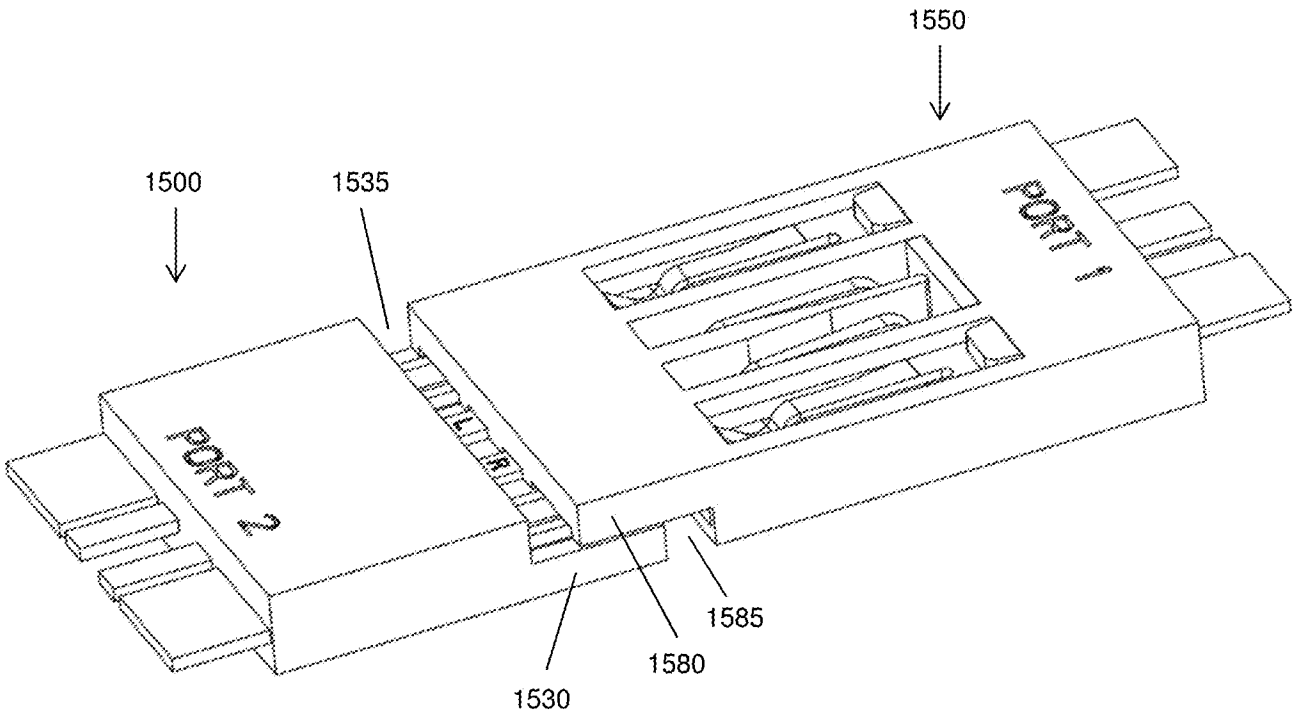
FIG. 15B is an isometric view of the exemplary electrical interconnection system of FIG. 15A, shown in a partially mated position, in accordance with some embodiments.

FIG. 15B is an isometric view of electrical interconnection system 90 shown in a partially mated position. In the example illustrated, mating contact portions 1510, 1511, 1513 and 1514 form electrical contacts with mating contact portions 1570, 1571, 1573 and 1574 respectively. Projecting member 1580 may occupy, at least in part, the region adjacent projecting member 1530 and intermediate portion 1501, which will be referred to herein as opening 1535. Projecting member 1530 may occupy, at least in part, the region adjacent projecting member 1580 and intermediate portion 1551, which will be referred to herein as opening 1585.

As discussed in connection with FIG. 4E, the presence of the projecting members may increase the effective dielectric constant of the mating regions 1502 and 1552 compared to the dielectric constant of region 403 illustrated in FIG. 4A as air may be replaced, at least in part, by dielectric material. Consequently, the magnitude of the change in impedance as a result of separation is less than had the entire space been filled with air as illustrated in FIG. 4A.

Figure 15C:
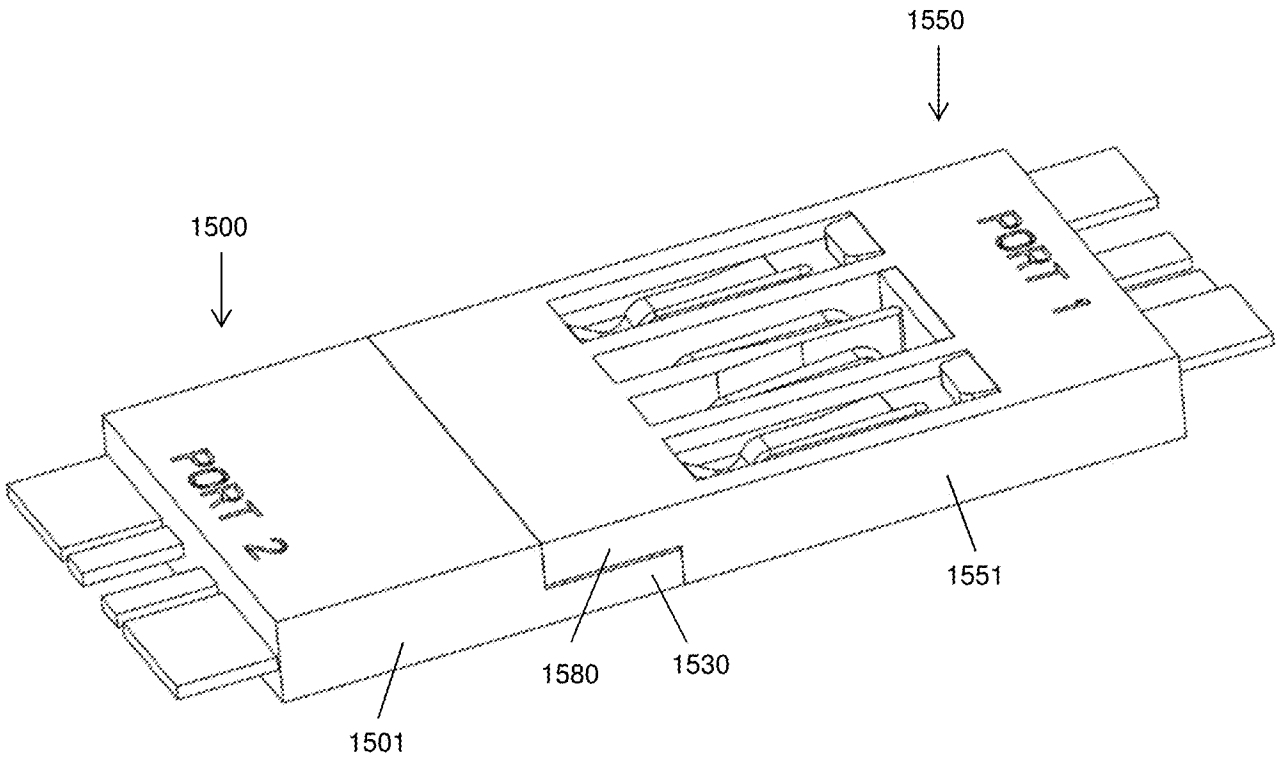
FIG. 15C is an isometric view of the exemplary electrical interconnection system of FIG. 15A, shown in a fully mated position, in accordance with some embodiments.

FIG. 15C is an isometric view of electrical interconnection system 90 shown in a fully mated position. In a fully mated position, projecting member 1530 may be in contact with intermediate portion 1551 and/or projecting member 1580 may be in contact with intermediate portion 1501.

Figure 16A:
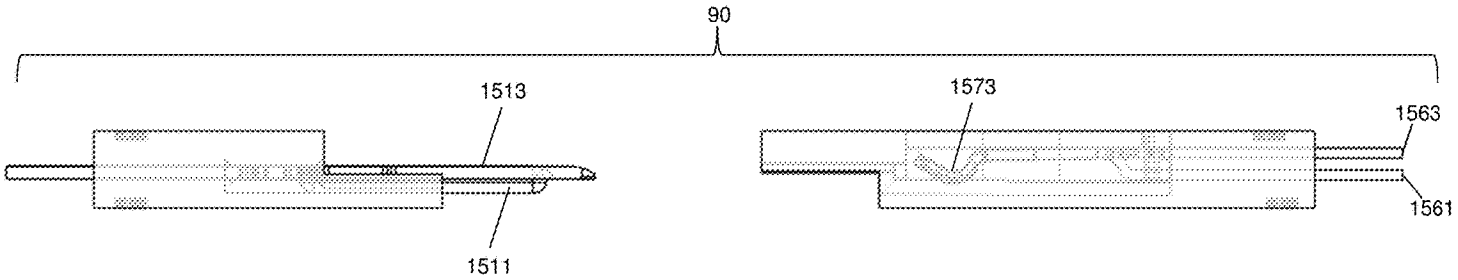
FIGS. 16A-16C are side views of mating connectors in three exemplary steps of a mating sequence, in accordance with some embodiments.
Figure 16B:
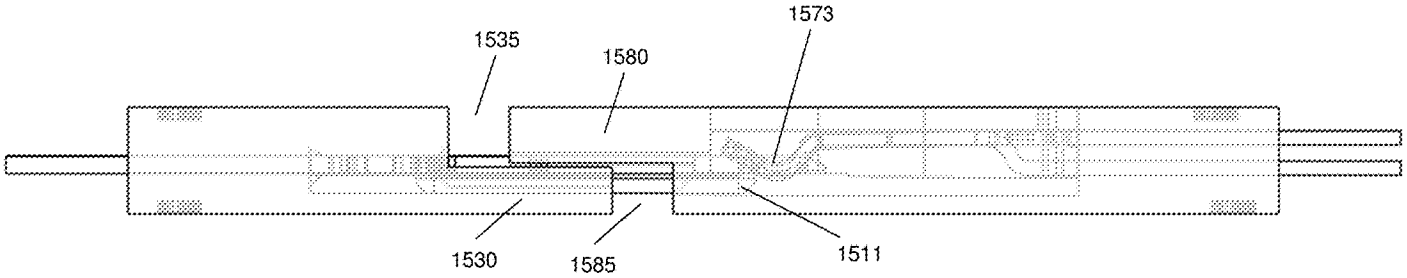
Figure 16C:
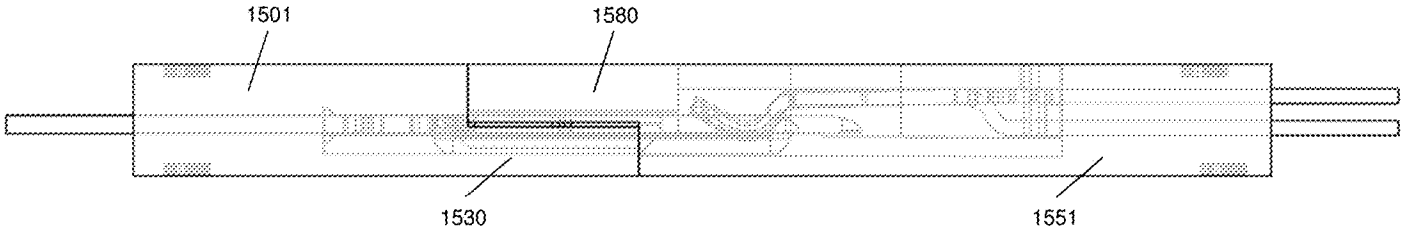

FIGS. 16A-16C illustrate three exemplary steps of a mating sequence, in accordance with some embodiments. In the example illustrated in FIG. 16A, electrical interconnection system 90 is shown in a demated position. FIG. 16A further illustrates mating contact portions 1511 and 1513 of connector 1500 and mating contact portion 1571 of connector 1550. Mating contact portion 1571 (not shown in FIG. 16A) may be connected to contact tail 1561, and mating contact portion 1573 may be connected to contact tail 1563.

The mating sequence may continue to the example illustrated in FIG. 16B, in which connector 1500 is positioned in proximity to connector 1550 such that projection member 1530 overlaps, at least in part, with projection member 1580 with respect to a plane that is perpendicular to the mating direction. In the partially mated position illustrated in FIG. 16B, the mating contact portions of connector 1500 may form electrical contacts with mating contact portions of connector 1550.

The mating sequence may continue by further sliding connector 1500 toward connector 1550, and/or vice versa.

FIG. 16C illustrate electrical interconnection system 90 is a fully mated position, in which projection member 1530 is in contact with intermediate portion 1551 and/or projection member 1580 is in contact with intermediate portion 1501.

In the fully mated position, the electrical interconnection system may exhibit an impedance profile along the mating direction that is substantially uniform. For example, the impedance profile may exhibit a variation along the mating direction that is less than 5 Ohms in some embodiments, less than 3 Ohms in some embodiments, less than 1 Ohm in some embodiments, or less than any other suitable value. In some embodiments, electrical interconnection system 90 may be designed to exhibit, in a fully mated position, an impedance that is less than the desired connector impedance by a few Ohms (e.g. 5 Ohms or less). However, if the interconnection system is operated, as often is the case, in a partially mated position, the impedance may slightly increase thus reducing the gap between the designed impedance and the desired impedance. By way of example and not limitation, a 100 Ohms interconnection system may be designed to exhibit a 96 Ohms impedance in the fully mated position. However, in some circumstances, the interconnection system may be operated in a partially mated position and may exhibit a maximum impedance that is between 98 Ohms and 102 Ohms.

Figure 17B:
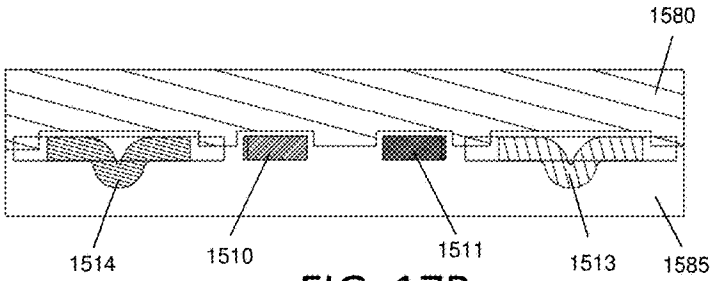
FIGS. 17B-17D are cross sectional views of the exemplary electrical interconnection system of FIG. 15A, in accordance with some embodiments.
Figure 17C:
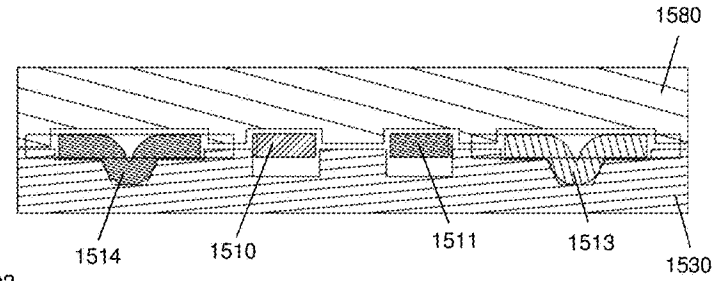
Figure 17D:
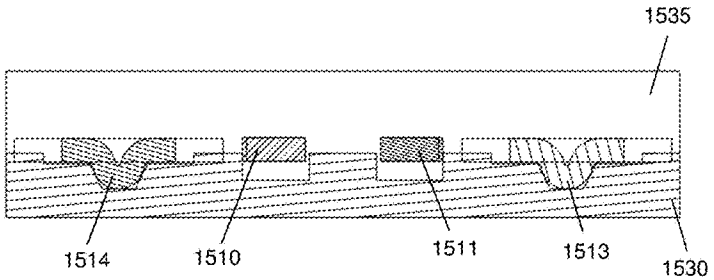
Figure 17A:
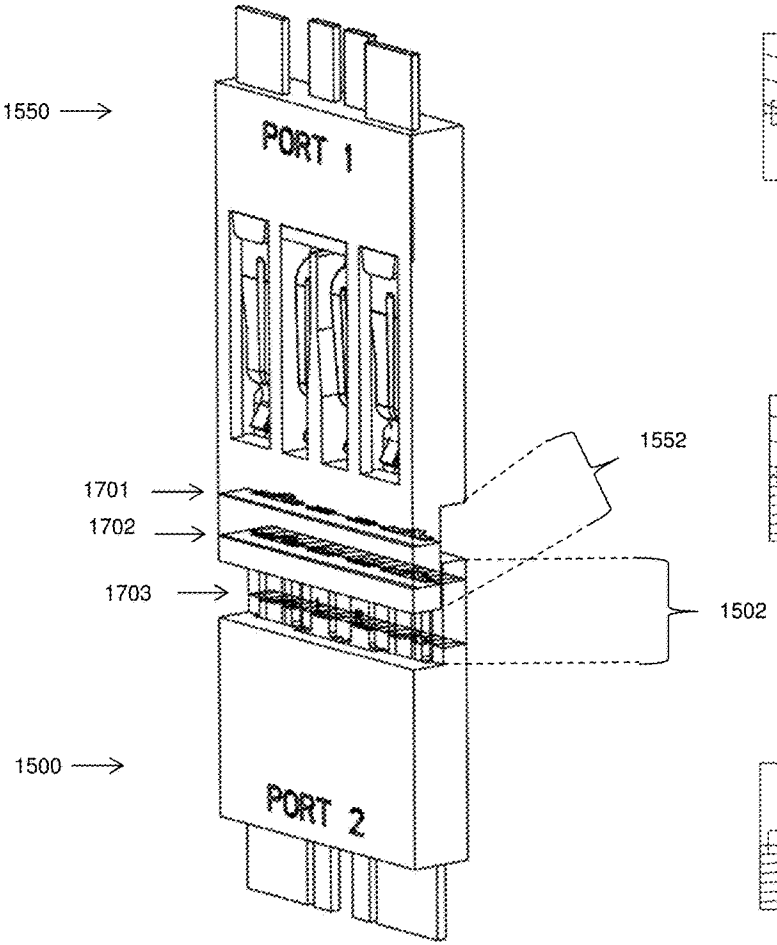
FIG. 17A is an isometric view of the exemplary electrical interconnection system of FIG. 15A, shown in a partially mated position.

FIG. 17A is a perspective view of electrical interconnection system 90 shown in a partially mated position. FIG. 17A illustrates cross sections 1701, 1702 and 1703 of the electrical interconnection system. Cross section 1701 is taken within mating region 1552 but outside mating region 1502. Cross section 1702 is taken within mating regions 1502 and 1552. Cross section 1703 is taken within mating region 1502 but outside mating region 1552. FIG. 17B, FIG. 17C and FIG. 17D illustrate cross sections 1701, 1702 and 1703 respectively, in accordance with some embodiments.

At cross section 1701, electrical interconnection system 90 may comprise mating contact portions 1510, 1511, 1513 and 1514 of connector 1500 and projecting member 1580 of connector 1550. FIG. 17B further illustrates opening 1585, adjacent projecting member 1580.

At cross section 1703, electrical interconnection system 90 may comprise mating contact portions 1510, 1511, 1513 and 1514 of connector 1500 and projecting member 1530 of connector 1500. FIG. 17D further illustrates opening 1535, adjacent projecting member 1530.

At cross section 1702, electrical interconnection system 90 may comprise mating contact portions 1510, 1511, 1513 and 1514 of connector 1500, projecting member 1530 of connector 1500 and projecting member 1580 of connector 1550. In some embodiments, projecting member 1530 and/or projecting member 1580 may comprise grooves positioned in correspondence with mating contact portions 1510, 1511, 1513 and 1514. In such embodiments, the mating contact portions may be surrounded, at least in part, by air.

Having thus described several aspects of at least one embodiment of this invention, it is to be appreciated that various alterations, modifications, and improvements will readily occur to those skilled in the art.

For example, FIG. 12A illustrates connector modules with mating faces with a stepped profile. In that embodiment, there is a single step in the profile. It should be appreciated that, in some embodiments, there may be multiple steps and/or the profile may be tapered to provide a less abrupt step.

Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein and in some instances. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An electrical connector, comprising:

a plurality of signal conductors disposed in a plurality of columns, each of the plurality of signal conductors comprising a mating contact portion and an intermediate portion, the mating contact portions being elongated in a first direction, and the plurality of signal conductors being disposed in a plurality of groups, each of the plurality of groups comprising at least one signal conductor of the plurality of signal conductors; and a housing comprising a first portion holding the intermediate portions of the plurality of signal conductors, wherein:

the housing comprises a plurality of projections extending in the first direction from the first portion with openings between adjacent projections of the plurality of projections; and the projections are disposed adjacent the mating contact portions of the plurality of signal conductors such that, for each of the plurality of columns of signal conductors, there is at least one of the plurality of projections and at least one of the openings adjacent the mating contact portions of the signal conductors of the columns.

2. The electrical connector of claim 1, wherein:

for each of the plurality of groups, the at least one of the plurality of projections is disposed beside the mating contact portions of the signal conductors of the group.

3. The electrical connector of claim 2, wherein:

the mating contact portions of the signal conductor of the group extend beyond the at least one of the plurality of projections in the first direction.

4. The electrical connector of claim 1, wherein:

the mating contact portions comprise receptacles, and wherein the receptacles are laterally offset, in a direction perpendicular to the first direction, relative to the plurality of projections.

5. The electrical connector of claim 4, wherein:

for each of the plurality of groups, there is at least one of the plurality of projections extending beyond a receptacle of the mating contact portions in the first direction.

6. The electrical connector of claim 1, wherein:

the housing further comprises a plurality of wafers, each of the plurality of wafers holding a column of the plurality of columns.

7. The electrical connector of claim 6, wherein:

each wafer of the plurality of wafers comprises a projection of the plurality of projections; and the openings are formed between projections on adjacent wafers of the plurality of wafers.

8. The electrical connector of claim 1, wherein:

the housing further comprises a plurality of modules, each of the plurality of modules holding a group of the plurality of groups.

9. The electrical connector of claim 1, wherein:

the mating contact portion is a first mating contact portion and each of the plurality of signal conductors comprises a second mating contact portion disposed alongside the first mating contact portion.

10. The electrical connector of claim 1, wherein:

the plurality of projections are formed with a dielectric material having a relative dielectric constant greater than one.

11. The electrical connector of claim 1, further comprising:

an electrically conducting shield adapted to enclose, at least in part, at least one group of the plurality of groups.

12. The electrical connector of claim 1, wherein at least one of the plurality of projections has a stepped profile.

13. The electrical connector of claim 1, wherein:

a volume of the projections is within 20% of a volume of the openings.

14. The electrical connector of claim 1, wherein:

the plurality of signal conductors is a first plurality of signal conductors, the intermediate portion is a first intermediate portion, the plurality of groups is a first plurality of groups, the housing is a first housing, the plurality of projections is a first plurality of projections, and the openings are first openings;

the electrical connector is a first electrical connector, and the first electrical connector is mated with a second electrical connector, the second electrical connector comprising:

a second plurality of signal conductors disposed in a second plurality of columns, each of the second plurality of columns corresponding to one of the first plurality of columns and each of the second plurality of signal conductors comprising a receptacle and a second intermediate portion, the second plurality of signal conductors being disposed in a second plurality of groups, each of the second plurality of groups comprising at least one second signal conductor of the second plurality of signal conductors;

a second housing comprising a second portion holding the second intermediate portions of the second plurality of signal conductors, wherein:

the second housing comprises a second plurality of projections extending in a second direction, opposite the first direction, from the second portion with second openings between adjacent second projections of the second plurality of projections;

each of the mating contact portions of the first plurality of signal conductors is in electrical contact with one of the receptacles of the second plurality of signal conductors; and each of the first plurality of projections is engaged with one of the second openings and each of the second plurality of projections is engaged with one of the first openings.

15. The electrical connector of claim 1, wherein, for each pair of signal conductors, there is at least one of the plurality of projections.

16. The electrical connector of claim 1, wherein each of the plurality of projections is made of a solid material.

17. The electrical connector of claim 1, wherein all of the plurality of signal conductors are of a same type of signal conductor.

18. A method for connecting a first electrical connector having a first housing, the first housing comprising a first plurality of projections extending along a mating direction and a first plurality of mating contact portions disposed in a first plurality of columns such that there is at least one of the first plurality of projections for each of the first plurality of columns of mating contacts, with a second electrical connector having a second housing, the second housing comprising a second plurality of projections extending along the mating direction and a second plurality of mating contact portions disposed in a second plurality of columns such that there is at least one of the second plurality of projections for each of the second plurality of columns of mating contacts, the method comprising:

positioning the first electrical connector in proximity to the second electrical connector;

sliding, along the mating direction, the first electrical connector toward the second electrical connector until:

each of the first plurality of mating contact portions of a first column of the first plurality of first columns is in electrical contact with one of the second plurality of mating contact portions of a second column of the second plurality of columns, each of the second plurality of projections is engaged with a first opening formed between adjacent first projections of the first plurality of projections and each of the first plurality of projections is engaged with a second opening formed between adjacent second projections of the second plurality of projections, and for each pair of adjacent columns of mating contacts of the second plurality of columns, there is at least one respective projection of the first plurality of projections disposed therebetween.

19. The method of claim 18, further comprising:

sliding, along the mating direction, the first electrical connector toward the second electrical connector until at least one of the first plurality of projections is in contact with a portion of the second housing.

20. The method of claim 18, wherein:

each of the first plurality of mating contact portions comprise a receptacle.

21. The method of claim 18, wherein:

each of the second plurality of mating contact portions comprise a receptacle.

* * * * *